US009075359B2

(12) United States Patent
Soeda

(10) Patent No.: US 9,075,359 B2
(45) Date of Patent: Jul. 7, 2015

(54) IMAGE FORMING APPARATUS WITH FUSION DEVICE HAVING A PLURALITY OF OPENING PARTS ON A HEAT TRANSMISSION MEMBER

(71) Applicant: Oki Data Corporation, Tokyo (JP)

(72) Inventor: Teruo Soeda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/905,265

(22) Filed: May 30, 2013

(65) Prior Publication Data

US 2013/0322941 A1 Dec. 5, 2013

(30) Foreign Application Priority Data

May 31, 2012 (JP) ..... 2012-124430

(51) Int. Cl.
*G03G 15/20* (2006.01)

(52) U.S. Cl.
CPC .... *G03G 15/2053* (2013.01); *G03G 2215/2022* (2013.01)

(58) Field of Classification Search
CPC ..... G03G 15/2064; G03G 2215/2016; G03G 15/2053
USPC ..... 399/322, 329
See application file for complete search history.

(56) References Cited

U.S. PATENT DOCUMENTS

| | | | | |
|---|---|---|---|---|
| 6,456,819 | B1 * | 9/2002 | Abe et al. | 399/329 |
| 7,623,817 | B2 * | 11/2009 | Jung et al. | 399/328 |
| 2008/0298862 | A1 * | 12/2008 | Shinshi | 399/324 |
| 2010/0092221 | A1 * | 4/2010 | Shinshi et al. | 399/330 |
| 2010/0226700 | A1 * | 9/2010 | Yamada et al. | 399/329 |
| 2011/0116848 | A1 * | 5/2011 | Yamaguchi et al. | 399/329 |
| 2011/0222931 | A1 * | 9/2011 | Shinshi et al. | 399/329 |
| 2011/0262193 | A1 * | 10/2011 | Kimura | 399/329 |
| 2011/0286775 | A1 * | 11/2011 | Ishihara et al. | 399/329 |
| 2013/0078018 | A1 * | 3/2013 | Yabuki | 399/329 |
| 2013/0084088 | A1 * | 4/2013 | Sakai | 399/45 |
| 2014/0093290 | A1 * | 4/2014 | Soeda | 399/329 |

FOREIGN PATENT DOCUMENTS

| | | | |
|---|---|---|---|
| JP | 2003-228253 | A | 8/2003 |
| JP | 2010-096823 | A | 4/2010 |
| JP | 2011-257455 | A | 12/2011 |

* cited by examiner

*Primary Examiner* — Clayton E Laballe
*Assistant Examiner* — Trevor J Bervik
(74) *Attorney, Agent, or Firm* — Muncy, Geissler, Olds & Lowe, P.C.

(57) ABSTRACT

A fusion device includes a heating member that includes a heating part and a heat transmission member that faces the heating member. The heat transmission member includes a first member that is configured to transmit heat from the heating part by facing the heating part and a second member that is configured to regulate a position of the heating member. And the second member includes an opening part.

14 Claims, 12 Drawing Sheets

IMAGE FORMING APPARATUS WITH FUSION DEVICE HAVING A PLURALITY OF OPENING PARTS ON A HEAT TRANSMISSION MEMBER

CROSS REFERENCE TO RELATED APPLICATION

The present application is related to, claims priority from and incorporates by reference Japanese Patent Application No. 2012-124430, filed on May 31, 2012.

TECHNICAL FIELD

The present invention relates to a fusion device and an image forming apparatus.

BACKGROUND

As a fusion device that fuses on a print medium, a device that includes a heat application member for heating a belt, and a heat transmission member that transmits the heat from the heat application member to the belt and that performs the fusion by the heated belt (see JP Laid-Open Patent Application No. 2011-257455, for example).

In the fusion device that includes a heating member having a heating part and a heat transmission member that transmits heat from the heating member, there is a case in which there is a difference in a heat expansion amount among members in a configuration that includes a member that contacts the heating part to transfer the heat and a member that regulates a position of the heating member. This may cause uneven deformation of the heat transmission member. When the uneven deformation of the heat transmission member occurs, the heat transmission from the heat transmission member to a heated body (e.g., a belt), for example, become uneven, resulting uneven heating of the heated body.

One of the objects of the present invention is to provide a fusion device and an image forming apparatus that reduces the uneven deformation of the heat transmission member that transmits the heat from the heating member.

One of the fusion devices disclosed in the application includes a heating member that includes a heating part and a heat transmission member that faces the heating member. The heat transmission member includes a first member that is configured to transmit heat from the heating part by facing the heating part and a second member that is configured to regulate a position of the heating member. And the second member includes an opening part.

Also, an image forming apparatus disclosed in the application includes an image forming part that is configured to form a developer image on a print medium; and the fusion device above. Herein, the fusion device is configured to fuse the developer image formed on the print medium by heat from the heating member.

According to the present invention, the uneven deformation of the heat transmission member that transmits the heat from the heating member is reduced.

DETAILED DESCRIPTION OF EMBODIMENTS

Embodiments of the present invention are explained below in accordance with the drawings.

First Embodiment

[Configuration of Image Forming Apparatus]

Figure 1:
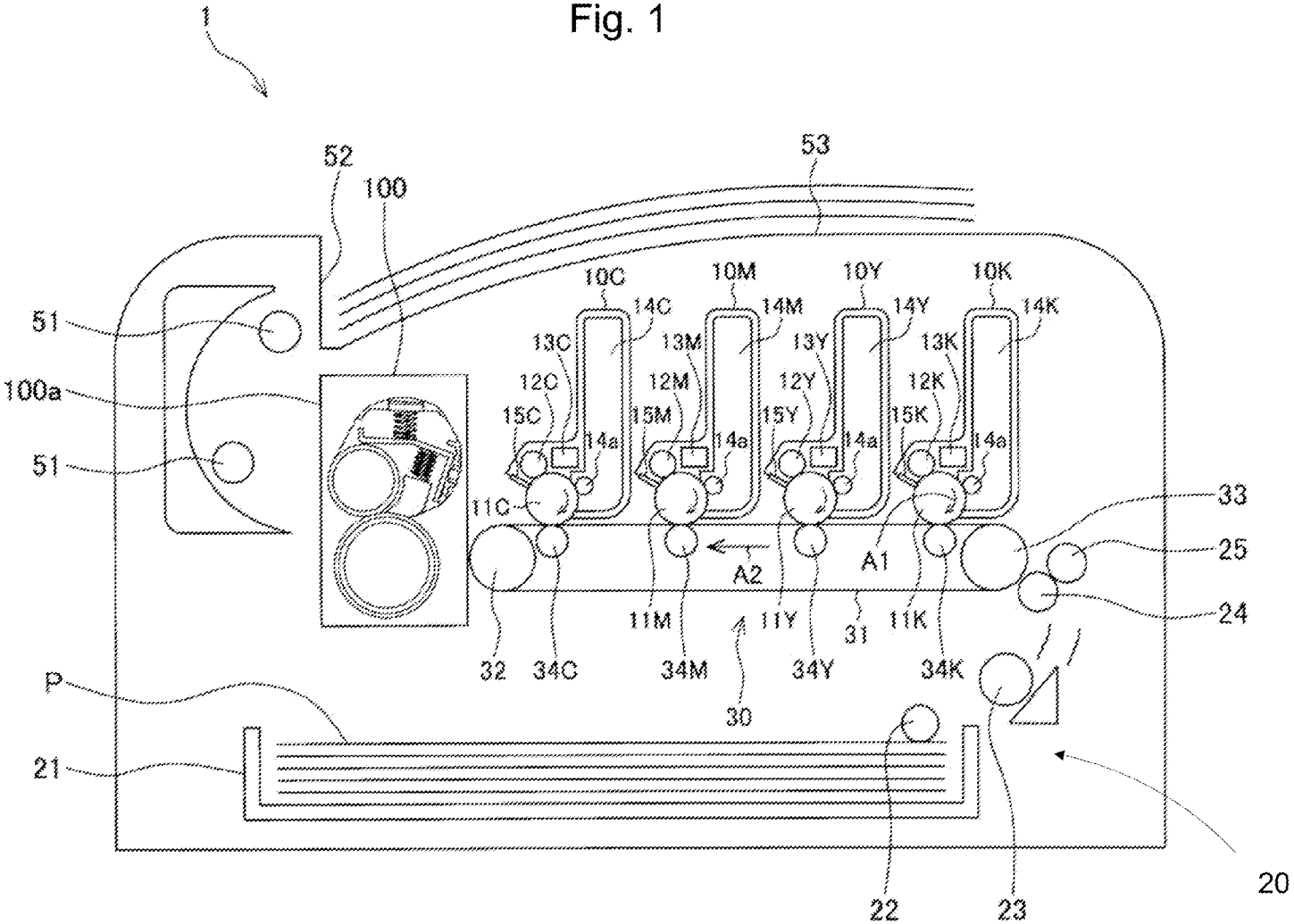
FIG. 1 is a schematic diagram illustrating an example of a configuration of an image forming apparatus that includes a fusion device in a first embodiment.

FIG. 1 is a schematic diagram illustrating an example of a configuration of an image forming apparatus 1 that includes a fusion device 100 in a first embodiment. The image forming apparatus 1 is an apparatus that forms an image by fusing a developer image on a print medium using the fusion device 100. More specifically, the image forming apparatus 1 is an electrographic printing apparatus and is a photocopy machine, a printer, a multi-function peripheral or a facsimile, for example. The image forming apparatus 1 forms a color image in the example shown in FIG. 1. However, the image forming apparatus 1 may form a single color image.

The image forming apparatus 1 includes image forming parts 10K, 10Y, 10M and 10C that form images in black, yellow, magenta and cyan, respectively. Each of the image forming parts 10K, 10Y, 10M and 10C forms a developer image of the corresponding color in response to image formation of black, yellow magenta and cyan.

The image forming part 10K includes a photosensitive body (e.g., photosensitive drum) 11K as an electrostatic latent image carrier, a charge device 12K, an exposure device 13K, a development device (alternatively, developer supply device) 14K, a cleaning device 15K and the like. The photosensitive drum 11K is a member that carries electrostatic latent images and rotates in a predetermined rotational direction (arrow A1 direction in FIG. 1). The charge device 12K, the exposure device 13K, the development device 14K and the cleaning device 15K are arranged in the order along the rotational direction A1 of the photosensitive drum 11K. The charge device 12K applies electric charge onto a surface of the photosensitive drum 11K to uniformly charge the surface. The exposure device 13K forms an electrostatic latent image by irradiating exposure light corresponding to image information onto the charged surface of the photosensitive drum 11K. The development device 14K is a device that forms a developer image by developing the electrostatic latent image formed on the photosensitive drum 11K with a developer. The development device 14K includes a development roller that supplies the developer to the photosensitive drum 11K. The cleaning device 15K removes the developer that remains on the surface of the photosensitive drum 11K after passing the later-described transfer region. The electrostatic latent image carrier is not limited to be in a drum shape but may be in a belt shape, for example.

Similar to the image forming part 10K, the image forming parts 10K, 10M and 10C respectively include photosensitive drums 11Y, 11M and 11C, charge devices 12K, 12M and 12C, exposure devices 13Y, 13M and 13C, development devices 14Y, 14M and 14C, cleaning devices 15Y, 15M and 15C, and the like. Explanation of configurations of the image forming parts 10Y, 10M and 10C is omitted as they are similar to the image forming part 10K.

The image forming apparatus 1 includes a sheet supply mechanism 20 for supplying print media P to the image forming parts 10K, 10Y, 10M and 10C. The sheet supply mechanism 20 includes a sheet supply cassette 21 that holds the print media P, which is a medium on which the developer image is formed. In addition, the sheet supply mechanism 20 includes a mechanism that separates and carries each of the print medium Pin the sheet supply cassette 21. More specifically, the sheet supply mechanism 20 includes a pickup roller 22 that takes up each of the print media P, such as sheets, stacked in the sheet supply cassette 21, a registration roller 23 that feeds the print media P taken up from the sheet supply cassette 21 at a timing of image formation at the image forming parts, and medium carrying roller 24 and 25 that carry the print medium P fed from the registration roller 23 toward the later-discussed transfer region.

The image forming apparatus 1 also includes a transfer device 30 that transfers the developer image formed by the image forming parts 10K, 10Y, 10M and 10C onto the print medium P. The transfer device 30 is a belt-type transfer device that is arranged to face each of the image forming parts 10K, 10Y, 10M and 10C and that forms the transfer region with each of the image forming parts 10K, 10Y, 10M and 10C. The transfer device 30 includes a transfer belt 31 as an endless transfer medium, a transfer medium tension roller 32 as a drive roller that drives the transfer belt 31, a transfer medium tension roller 33 as a tension roller that applies tension to the transfer belt 31, and transfer rollers 34K, 34Y, 34M and 34C. The transfer belt 31 is a member that carries the print medium P from the sheet supply mechanism 20 and tensioned freely travelable by the transfer medium tension roller 32 and 33. The transfer belt 31 holds the print medium P on the surface thereof and travels in the predetermined travelling direction (arrow A2 direction in FIG. 1) due to rotation of the transfer medium tension roller 32 to carry the print medium P along the image forming parts 10K, 10Y, 10M and 10C. Each of the transfer rollers 34K, 34Y, 34M and 34C are members for transferring developer image formed by the corresponding photosensitive drums 11K, 11Y, 11M and 11C onto the print medium P and are arranged to face the photosensitive drum 11K, 11Y, 11M and 11C over the transfer belt 31. The transfer region, which is a region in which the developer image is transferred onto the print medium P, is formed between the photosensitive drums 11K, 11Y, 11M and 11C and the transfer belt 31.

Moreover, the image forming apparatus 1 includes a fusion device 100 that fuses the developer image transferred onto the print medium P by the transfer device 30. The fusion device 100 is explained in detail later.

On the downstream side of the fusion device 100 in the carrying direction of the print medium P, medium carrying rollers 51 that carry the print medium P, on which the developer image has been fused by the fusion device 100, a print medium ejection opening 52 through which the printed print medium P carried from the medium carrying rollers 51 is ejected, and a ejected sheet stacking part 53 that stacks the printed print medium P that is ejected from the print medium ejection port 52 are arranged.

[Configuration of Fusion Device]

Figure 2:
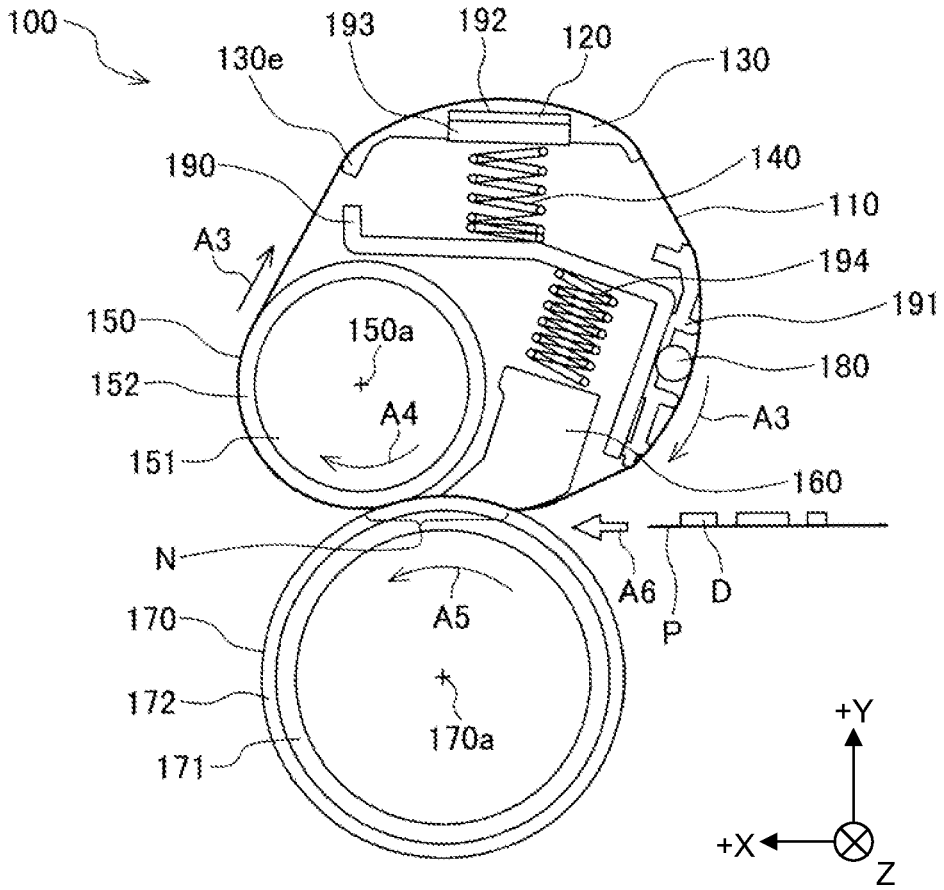
FIG. 2 is a schematic cross-sectional view illustrating a configuration of the fusion device in the first embodiment.

FIG. 2 is a schematic cross-sectional view illustrating a configuration of the fusion device 100 in the first embodiment. In FIG. 2, the fusion device 100 includes a belt (or fusion belt) 110 as a fusion member, a heater 120 as a heating member, a heat transmission member 130, a spring 140 as an elastic member, a fusion roller 150 as a first roller, a pressure application pad 160 as a pressure application member, a pressure application roller 170 as a second roller, and a temperature sensor 180.

The belt 110 is an endless member that moves in a predetermined moving direction (or carrying direction; arrow A3 direction in FIG. 2) and is a member for heating and melting a developer image D on the print medium P. The belt 110 is tensioned by the fusion roller 150, the heat transmission member 130 and a guide member 191 provided on a support member 190 that is fixed to a main body frame 100*a* of the fusion device 100. The belt 110 has a width in a direction perpendicular to a belt moving direction (BMD) and a thickness direction of the belt 110. A position of the belt 110 in a longitudinal direction, which is the width direction, is regulated by a flange part (not shown). The belt 110 includes a polyimide base that configures an inner surface, an elastic layer made of a silicone rubber that forms an outer circumference of the base, and a PFA (tetra fluoro ethylene-perfluoro alkylvinyl ether copolymer) tube that is a surface layer formed on the outer circumference of the elastic layer. In the below explanation, the moving direction of the belt 110 is referred to as a belt moving direction BMD.

The heater 120 includes a heating part and is a member for heating the belt 110, which is a heated body. The heating part is a part of the heater 120 that generates heat, and more specifically, a part in which a heating body is arranged. The heater 120 is a member that extends in the longitudinal direction and is arranged so that the longitudinal direction intersects perpendicularly to the thickness direction (TD) and the belt moving direction (BMD) of the belt 110 (i.e., the longitudinal direction is in parallel with the longitudinal direction of the belt 110), see FIG. 3.

Figure 3:
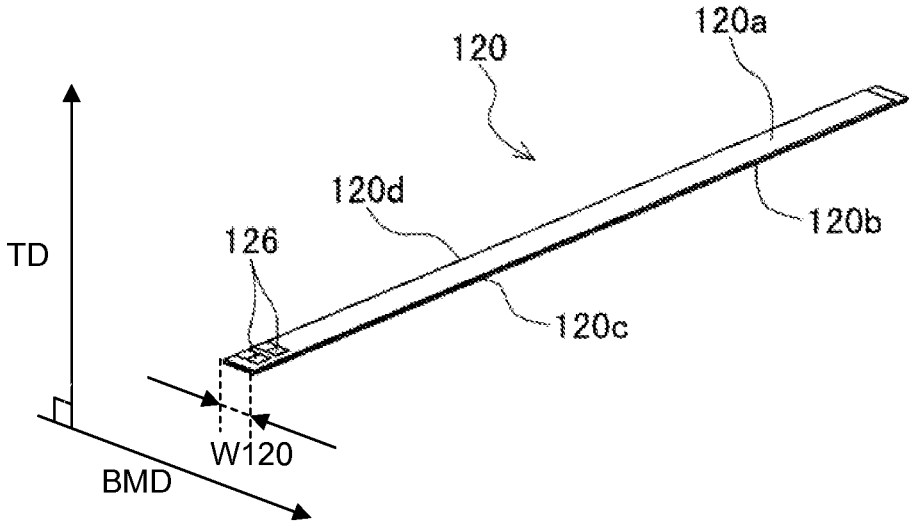
FIG. 3 is a perspective view illustrating a configuration of a heater.

FIG. 3 is a perspective view illustrating a configuration of the heater 120. In FIG. 3, the heater 120 includes a heating surface 120*a*, which is a surface heater and functions as the heating part. The heating surface 120*a* is a surface of the surfaces configuring the heater 120 that generates heat, and more specifically, a surface on which the heating body is arranged. Moreover, the heater 120 includes a back surface 120*b* that is a surface on a side opposite from the heating surface 120*a*, an end part (end surface) 120*c* on the downstream side of the belt moving direction BMD, shown in FIG. 3, and a side part (side surface) 120*d* on the upstream side of the belt moving direction BMD. The heater 120 has a rectangular cross-sectional shape in a cross-section perpendicular to the longitudinal direction, for example.

Figure 4:
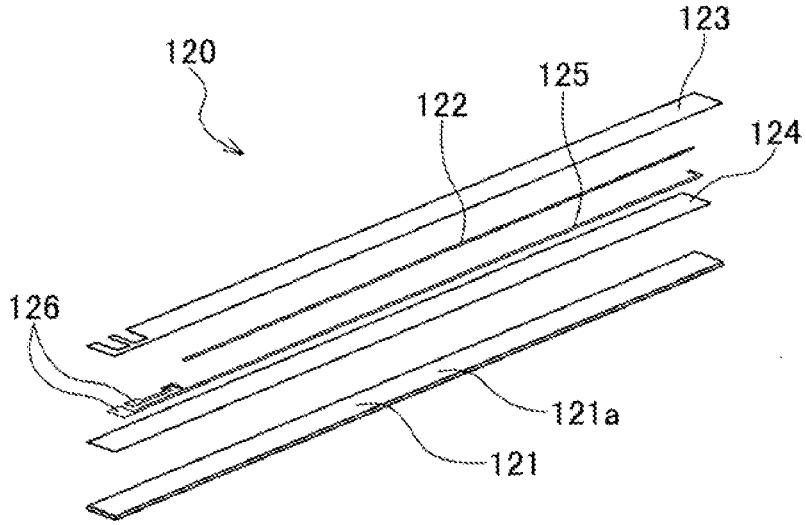
FIG. 4 is an exploded perspective view illustrating the configuration of the heater.

FIG. 4 is an exploded perspective view illustrating a configuration of the heater 120. In FIG. 4, the heater 120 includes a planar (or tabular) base 121 that extends in the longitudinal direction. A resistance wire 122 as a heating body that generates heat is provided on a surface 121*a* of the base 121 to thereby form the heating surface 120*a*. The resistance wire 122 is a resistance heating body that generates heat as electric current flows therethrough. Protective layers 123 and 124 are provided on and under the resistance wire 122, respectively. That is, the resistance wire 122 is provided on the base 121 via the protective layer 124 and is covered by the protective layer 123. The protective layers 123 and 124 function to prevent the electric current flowing to the resistance wire 122 from leaking to the base 121 and other members. In addition, the resistance wire 122 is connected to a contact part 126 via a wire 125. The wire 125 is provided on the base 121 via the protective layer 124 and is covered by the protective layer 123. The wire 125 may function as a resistance wire that generates heat as electric current flows therethrough. The contact part 126 is provided on the base 121 via the protective layer 124. The contact part 126 is connected to the later-discussed fusion controller 208 as being connected to a connector (not shown) and receives supply of electricity from the fusion controller 280 through the connector.

Referring to FIG. 2 again, the heat transmission member 130 is a member that is arranged between the heater 120 and the belt 110 and that transmits the heat from the heater 120 to the belt 110 by contacting the heater 120. The heat transmission member 130 is a member that extends in the longitudinal direction and is arranged so that the longitudinal direction intersects perpendicularly to the thickness direction and the belt moving direction of the belt 110 (i.e., the longitudinal direction is in parallel with the longitudinal direction of the belt 110).

Figure 5B:
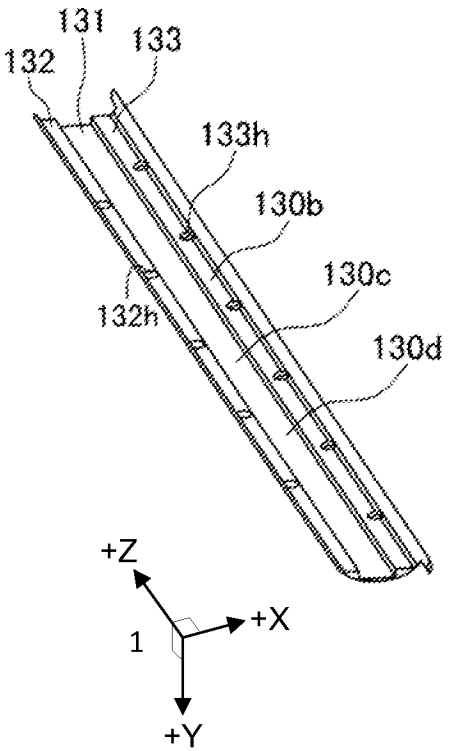
FIGS. 5A and 5B are perspective views illustrating a configuration of a heat transmission member in the first embodiment.
Figure 5A:
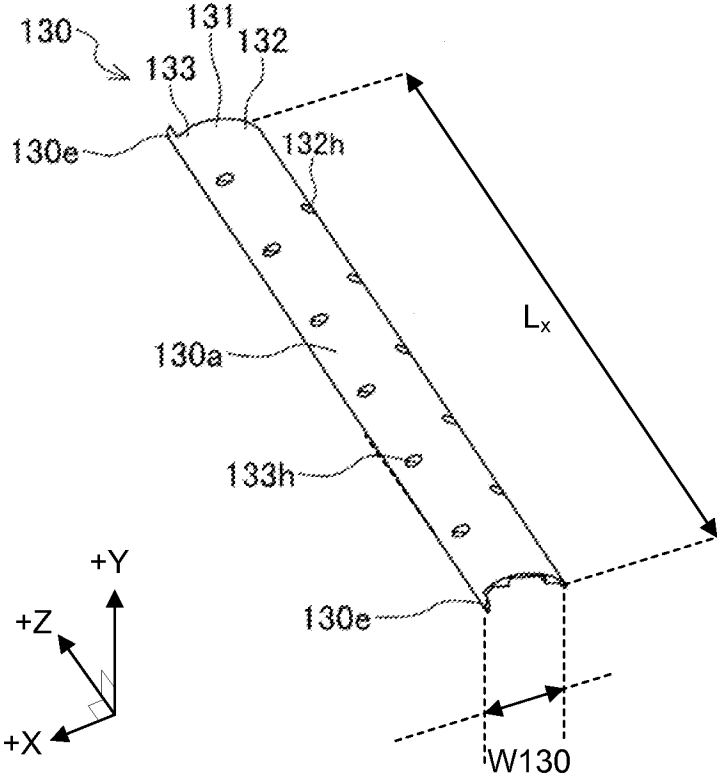

FIGS. 5A and 5B are perspective views illustrating a configuration of the heat transmission member 130. FIG. 5A is a view seen from the belt 110 side, and FIG. 5B is a view seen from the heater 120 side, which is a side opposite from the belt 110 side. In FIGS. 5A and 5B, the heat transmission member 130 includes a surface (hereinafter referred to as belt contact surface) 130*a* that contacts the belt 110, which is the heated body, and a surface (hereinafter referred to as a back surface) 130*b* on the side opposite from the belt contact surface 130*a*. A surface (hereinafter referred to as a heater contact surface) 130*c* that contacts the heating part of the heater 120 is provided on the back surface 130*b*. The belt contact surface 130*a* is a curved surface that is convex toward the belt 110 side as seen from the longitudinal direction of the heat transmission member 130. A width W130 of the belt contact surface 130*a* along the belt moving direction is preferably 30 [mm] or more from a view point for stably transmitting heat to the belt 110. The heater contact surface 130*c* is a planar surface that extends in the longitudinal direction of the heat transmission member 130.

Figure 6A:
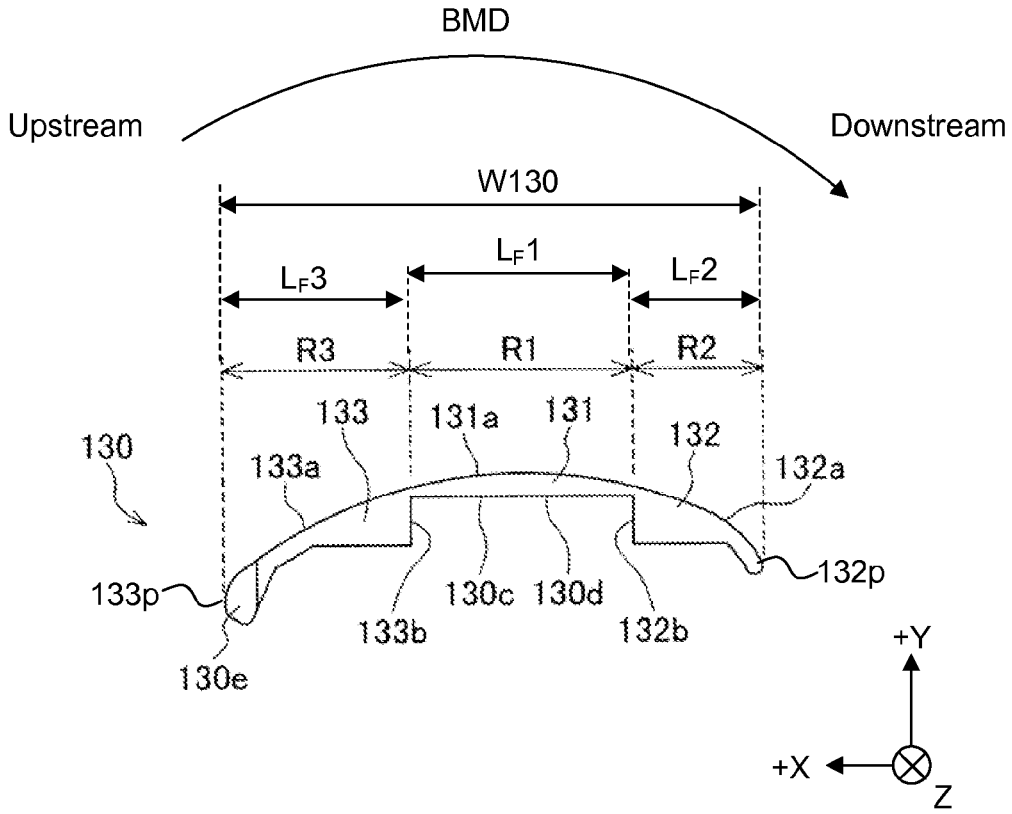
FIGS. 6A and 6B are a side views illustrating a configuration of the heat transmission member in the first embodiment.

FIG. 6A are side views illustrating a configuration of the heat transmission member 130. In FIG. 6A, the heat transmission member 130 is configured from a first member 131, a second member 132 and a third member 133. Each of the first member 131, the second member 132 and the third member 133 is a member that extends in the longitudinal direction of the heat transmission member 130. In the belt moving direction BMD shown in FIG. 6A, the second member 132 is arranged on the downstream side of the first member 131, and the third member 133 is arranged on the upstream side of the first member 131.

The first member 131 is a member that contacts the heating surface 120*a* that functions as the heating part formed on the heater 120 and that transmits the heat from the heating surface 120*a* to the belt 110. Therefore, the first member 131 may also be called a heat transmission part. The first member 131 transmits the heat from the resistance wire 122 to the belt 110. In the present embodiment, the first member 131 contacts the resistance wire 122 via the protective layer 123. The first member 131 includes a belt contact surface 131*a* that configures a middle region R1 in the belt moving direction on the belt contact surface 130*a*, and the heater contact surface 130*c*. The heat from the heating surface 120*a* (or resistance wire 122) is received by the heater contact surface 130*c*. The heat is transmitted from the belt contact surface 131*a* to the belt 110. For one example, the heating surface 120*a* is heated up to an upper limit that is about from 200° C. to 300° C. Also, the heat transmission member 130 is heated by the heating surface 120*a* such that the upper limit of the temperature falls within a range between 160° C. to 250° C.

The second member 132 is a member that regulates the movement of the heater 120 toward the downstream side in the belt moving direction and thereby regulates the position of the heater 120. The second member 132 may also be called a downstream side regulation part. Specifically, the second member 132 regulates the position of the end part of the heater 120 by contacting or facing the end part of the base 122 without contacting the heating surface 120*a* the functions as the heating part (or the registration wire 122 that functions as the heating body). More specifically, the second member 132 includes a regulation surface 132*b* that contacts or faces the end part 120*c* of the heater 120 on the downstream side of the belt moving direction and that regulates the position of the end part 120*c* by the regulation surface 132*b*. In addition, the second member 132 transmits the heat from the end part 120*c* of the heater 120 and the heat transmitted from the first member 131 toward the downstream side in the belt moving direction. Furthermore, the second member 132 includes a belt contact surface 132*a* that configures a downstream region R2 in the belt moving direction on the belt contact surface 130*a* and transmits the heat from the belt contact surface 132*a* to the belt 110.

The third member 133 is a member that regulates the movement of the heater 120 toward the upstream side in the belt moving direction and thereby regulates the position of the heater 120. The third member 133 may be called an upstream side regulation part. Specifically, the third member 133 regulates the position of the end part of the heater 120 by contacting or facing the end part of the base 122 without contacting the heating surface 120*a* the functions as the heating part (or the registration wire 122 that functions as the heating body). More specifically, the third member 133 includes a regulation surface 133*b* that contacts or faces the end part 120*d* of the heater 120 on the upstream side of the belt moving direction and that regulates the position of the end part 120*d* by the regulation surface 133*b*. In addition, the third member 133 transmits the heat from the end part 120*d* of the heater 120 and the heat transmitted from the first member 131 toward the upstream side in the belt moving direction. Furthermore, the third member 133 includes a belt contact surface 133*a* that configures an upstream region R3 in the belt moving direction on the belt contact surface 130*a* and transmits the heat from the belt contact surface 133*a* to the belt 110.

As shown in FIGS. 5A and 5B, the second member 132 includes holes 132*h* as opening parts, and the third member 133 includes holes 133*h* as opening parts. The opening parts are explained in detail later.

Figure 6B:
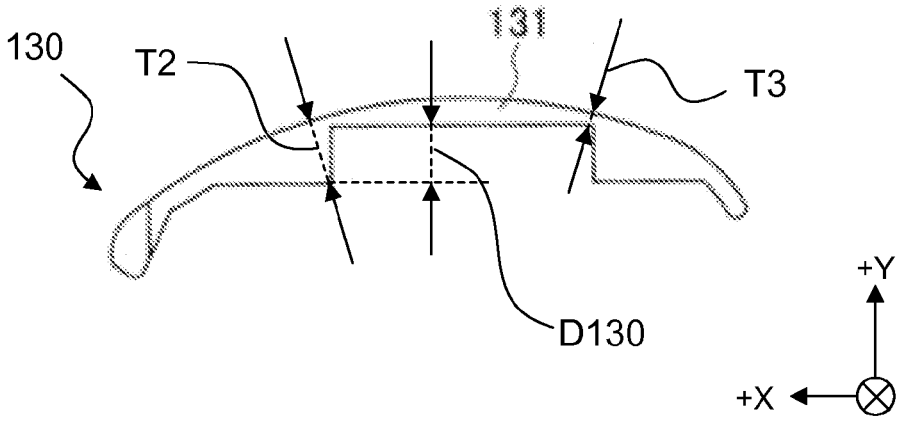

In the example shown in FIGS. 5A, 5B and 6, the heat transmission member 130 is a partially cylindrical shape member that includes the heater contact surface 130*a* as an outer circumferential surface. A recess part 130*d* that extends in the longitudinal direction of the heat transmission member 130 is formed on the back surface 130*b*, which is the inner circumferential surface of the heat transmission member 130. The recess part 130*d* includes the heater contact surface 130*c* as a bottom surface, the regulation surface 132*b* as a side surface on the downstream side of the belt moving direction, and the regulation surface 133*b* as a side surface on the upstream side of the belt moving direction. Then, the holes 132*h* are provided at a part of the recess part 130*d* of the heat transmission member 130 on the downstream side of the belt moving direction, and the holes 133*h* are provided at a part on the upstream side of the belt moving direction. In view of securely fixing the heater 120 inside the recess part 130*d*, the width $L_F$ of the recess part 130*d* is preferred to be substantially the same as the width W120 of the heather. Thereby, once the heater is equipped in the recess part 130*d*, the heater 120 is restricted from moving toward the belt moving direction BMD.

Furthermore, the heat transmission member 130 includes a pair of support points 130*e* on the both end parts in the longitudinal reaction. The heat transmission member 130 is positioned in a state where the support points 130*e* are held by the main body frame 100*a* and is rotatably displaceable about the support points 130*e*. In FIGS. 5A, 5B and 6A and 6B, the pair of support points 130*e* are arranged on the end parts of the heat transmission member 130 on the upstream side in the belt moving direction.

In the embodiment, a width W120 of the heater 120 is 12 mm, a thickness D120 is 1 mm. A width W130 of the heat transmission member 130 has substantially the same scale as the width W120 of the heater 120 that is 12.4 mm (a little larger than the width W120). Herein, the "substantially the same scale" means a range from 95% to 110% with respect to the width W120. A thickness D130 is 2.7 mm. The thickness D130 is defined as a height of the recess part 130*d*. It is preferred that the thickness D130 is larger than the thickness D120. In the embodiment, among various thicknesses of the heat transmission member 130, a thickness T2 that is the thickest is 3.1 mm, a thickness T3 that is the thinnest is 0.5 mm. It is preferred that the thickness T2 is set within 2.0 mm to 5 mm, the T3 is 0.4 mm to 3 mm. An average thickness of the first member may be smaller than average thicknesses of the second and third members. Thereby, when the members are heated in the same manner, the deformation of the first member is different from the deformations of other members.

Referring to FIG. 2 again, heat transmission grease 192 is applied between the heater 120 and the heater contact surface 130*c* of the heat transmission member 130. The heat transmission grease 192 functions to increase heat transmission efficiency between the heater 120 and the heater contact surface 130*c* of the heat transmission member 130 by filling a small gap existing therebetween.

The spring 140 is an elastic member that pushes the heater 120 against the heat transmission member 130 and that pushes the heat transmission member 130 against the belt 110. Specifically, a pressure application plate 193 is arranged on the back surface 120*b* on the opposite side from the heating surface 120*a* of the heater 120. The spring 140 is positioned between the support member 190 fixed on the main body frame 100*a* of the fusion device 100 and the pressure application plate 193. The spring 140 pushes the pressure application plate 193 in a direction to tension the belt 110 by pushing the heat transmission member 130. As a result, the pressure application plate 193 presses the heater 120, and the heater 120 presses the heater contact surface 130*c* of the heat transmission member 130. Moreover, the heat transmission member 130 is fixed to the main body frame 100*a* of the fusion device 100 freely rotatably about the support points 130*e*. Therefore, the belt contact surface 130*a* of the heat transmission member 130 is pressed against the inner surface of the belt 110 due to biasing by the spring 140, and thereby the belt 110 is tensioned.

The fusion roller 150 is arranged on the inner circumference side of the belt 110 so as to contact the inner surface of the belt 110. The fusion roller 150 is a member that extends in the longitudinal direction and is arranged so that the longitudinal direction intersects perpendicularly to the thickness direction and the belt moving direction of the belt 110 (i.e., the longitudinal direction is in parallel with the longitudinal direction of the belt 110). Moreover, the fusion roller 150 is positioned rotatably about a rotational axis 150*a* that is parallel to the longitudinal direction of the fusion roller 150. Specifically, the fusion roller 150 includes a core part 151 and an elastic layer 152 formed on the outer circumference of the core part 151. Both end parts of the core part 151 in the longitudinal direction thereof are supported by rotation shaft bearings (not shown) arranged on the main body frame 100*a*. A drive system (not shown) is connected to one of the end parts of the core part 151 in the longitudinal direction thereof. The fusion roller 150 is able to perform the rotational movement as a motive force is applied from the drive system to the core part 151. In the present embodiment, the fusion roller 150 rotates about the rotational axis 150*a* in the arrow A4 direction.

The pressure application pad 160 is arranged on the inner circumference side of the belt so as to contact the inner surface of the belt 110. The pressure application pad 160 is arranged on the upstream side of the fusion roller 150 in the belt moving direction. The pressure application pad 160 is a member that extends in the longitudinal direction and is arranged so that the longitudinal direction intersects perpendicularly to the thickness direction and the belt moving direction of the belt 110 (i.e., the longitudinal direction is in parallel with the longitudinal direction of the belt 110). The pressure application pad 160 includes longitudinal direction both end parts that are held by support members (not shown) arranged on the main body frame 100*a* in a state displaceable in a direction to contact the pressure application roller 170 (Y axis direction). The pressure application pad 160 is pressed in a direction to press the pressure application roller 170 (−Y direction) over the belt 110 by the spring 194 that functions as an elastic member.

The pressure application roller 170 is arranged to face the fusion roller 150 and the pressure application pad 160 over the belt 110. The pressure application roller 170 is a member that extends in the longitudinal direction and is arranged so that the longitudinal direction intersects perpendicularly to the thickness direction and the belt moving direction of the belt 110 (i.e., the longitudinal direction is in parallel with the longitudinal direction of the belt 110). Moreover, the pressure application roller 170 is positioned rotatably about a rotational axis 170*a* that is parallel with the longitudinal direction of the pressure application roller 170. Specifically, the pressure application roller 170 includes a core part 171 and an elastic layer 172 formed on the outer circumference of the core part 171. Both end parts of the core part 171 in the longitudinal direction thereof are supported by rotation shaft bearings (not shown) arranged on the main body frame 100*a*. Moreover, the pressure application roller 170 is pressed in the +Y direction by a pressure application mechanism (not shown). As a result, the elastic layer 172 of the pressure application roller 170 is pressed against the elastic layer 152 of the fusion roller 150 and the pressure application pad 160 over the belt 110 and forms a nip region (or nip part) N between the pressure application roller 170 and the belt 110. The pressure application roller 170 rotates about the rotational axis 170*a* in the arrow A5 direction in accordance with the rotation of the fusion roller 150.

The temperature sensor 180 is a sensor that detects a temperature of the belt 110. More specifically, the temperature sensor 180 contacts the inner surface of the belt 110 and sends temperature information that indicates the temperature of the belt 110 to a fusion sensor 208. The temperature sensor 180 is a thermistor, for example.

[Configuration of Control System]

Figure 7:
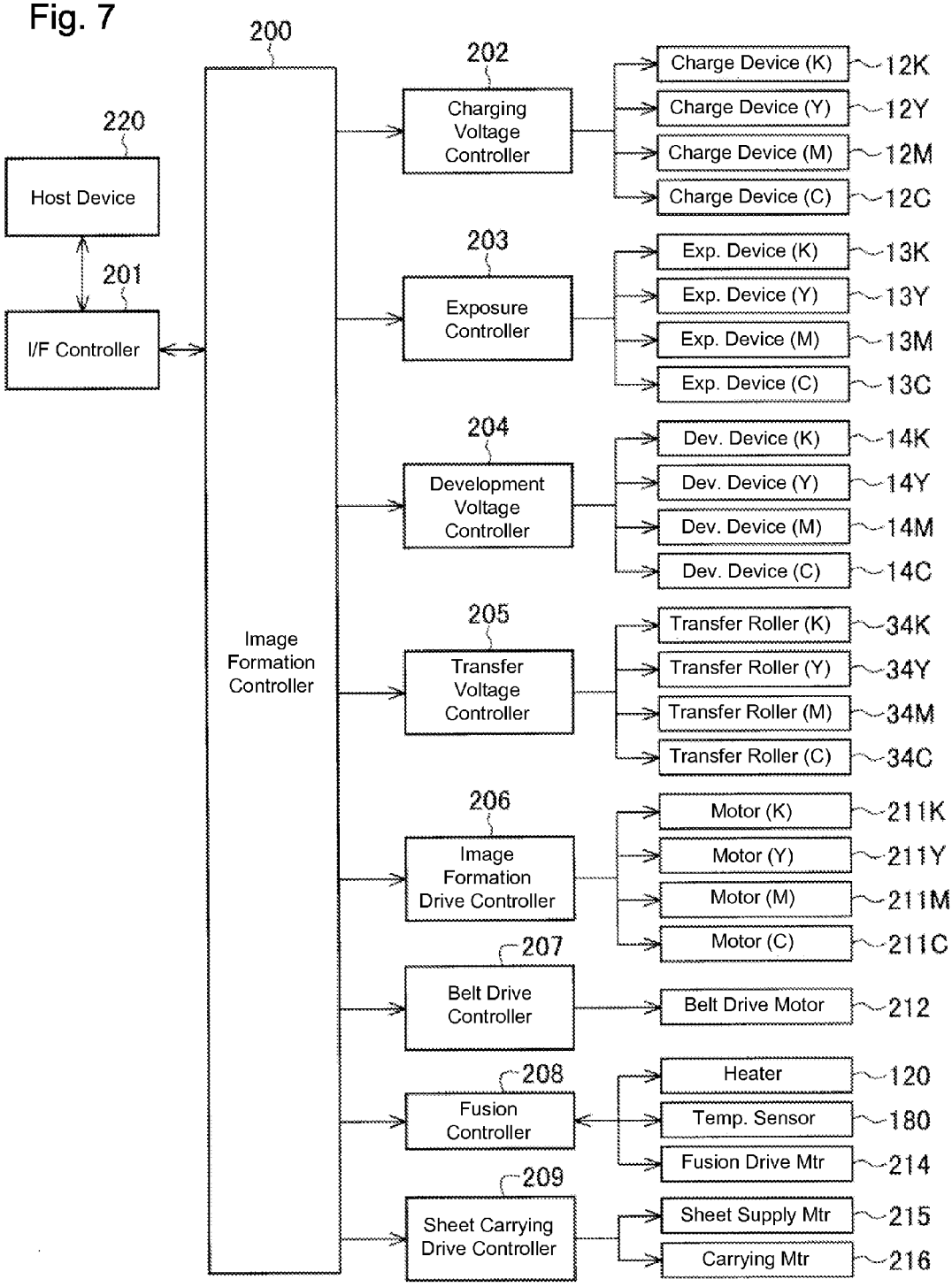
FIG. 7 is a block diagram illustrating a control system of the image forming apparatus.

FIG. 7 is a block diagram illustrating a control system of the image forming apparatus 1. In FIG. 7, the image forming apparatus 1 includes an image formation controller 200, an interface (I/F) controller 201, a charging voltage controller 202, an exposure controller 203, a development voltage controller 204, a transfer voltage controller 205, an image formation drive controller 206, a belt drive controller 207, a fusion controller 208 and a sheet supply carriage drive controller 209.

The image formation controller 200 controls the entire image forming apparatus 1 and is configured from a microprocessor, a read only memory (ROM), a random access memory (RAM), an input/output port, a timer and the like. The image formation controller 200 receives print data as image information and control commands from a host device 220, such as a personal computer or the like, via the I/F controller 201 and performs a sequential control of the image forming apparatus 1.

The I/F controller 201 transmits information of the image forming apparatus 1 to the host device 220. The I/F controller 201 also analyzes the commands transmitted from the host device 220 and processes the data transmitted from the host device 220.

The charging voltage controller 202 controls application of charging voltage to the charge rollers 12K, 12Y, 12M and 12C to uniformly charge the surface of the corresponding photosensitive drum of the image forming parts 10K, 10Y, 10M and 10C in accordance with an instruction from the image formation controller 200.

The exposure controller 203 controls the driving of the exposure devices 13K, 13Y, 13M and 13C based on the print data to expose the surface of the respective photosensitive drums and to form electrostatic latent images thereon in accordance with an instruction from the image formation controller 200.

The development voltage controller 204 controls application of development voltage to the development devices 14K, 14Y, 14M and 14C to develop the electrostatic latent images formed on the surface of the respective photosensitive drums in accordance with an instruction from the image formation controller 200.

The transfer voltage controller 205 controls application of transfer voltage to the transfer rollers 34K, 34Y, 34M and 34C to transfer the developer images (e.g., toner images) formed on the surface of the respective photosensitive drums onto the print medium P in accordance with an instruction from the image formation controller 200.

The image formation drive controller 206 controls driving of motors 211K, 211Y, 211M and 211C provided on the corresponding image forming part to rotate and drive the respective photosensitive drums, charge rollers and development rollers of the image forming parts 10K, 10Y, 10M and 10C, in accordance with an instruction from the image formation controller 200.

The belt drive controller 207 controls driving of a belt drive motor 212 to drive the transfer belt 31 by rotating the transfer medium tension roller 32 that functions as a drive roller, in accordance with an instruction from the image formation control part 200. In accordance with the driving of the transfer medium tension roller 32 that functions as a drive roller, the transfer belt 31 that functions as a transfer medium, a transfer medium tension roller 33 that functions as a tension roller, and the tension rollers 34K, 34Y, 34M and 34C are also rotated.

The fusion controller 208 receives an input of a detected temperature from the temperature sensor 180 that detects a temperature of the fusion device 100 and controls current passage (e.g., on/off control) to the heater 120 of the fusion device 100 based on the detected temperature. More specifically, the fusion controller 208 controls the current passage to the heater 120 based on the detected temperature from the temperature sensor 180 so that the temperature of the belt 110 is at a predetermined temperature to perform excellent fusion. Moreover, the fusion controller 208 controls driving of a fusion drive motor 214 that rotates the fusion roller 150 of the fusion device 100 in accordance with an instruction from the image formation controller 200. The pressure application roller 170 that contacts the fusion roller 150 over the belt 110 and the belt 110 are rotated by the fusion roller 150.

The sheet supply carriage drive controller 209 controls driving of a sheet supply motor 215 and a carrying motor 216 to supply and carry the print medium P in accordance with an instruction from the image formation controller 200. The sheet supply motor 215 rotates and drives the pickup roller 22. The carrying motor 216 rotates and drives the registration roller 23 and the medium carrying rollers 24, 25 and 51.

[Operation of Image Forming Apparatus]

Next, operation of the image forming apparatus 1 is explained. When a print command is received from the host device 220, the image formation controller 200 of the image forming apparatus 1 rotates the pickup roller 22 to feed the print medium P from the sheet supply cassette 21 and carries the print medium P to the transfer belt 31 using the registration roller 23 and the medium carrying rollers 24 and 25.

Moreover, the image forming controller 200 forms a developer image of each color on the photosensitive drum 11K, 11Y, 11M and 11C using the image forming parts 10K, 10Y, 10M and 10C. In this case, at the image forming part 10K, the surface of the photosensitive drum 11K is exposed by the exposure device 13K after being charged by the charge device 12K in accordance with the rotation of the photosensitive drum 11K in the arrow A1 direction. Thereby, an electrostatic latent image is formed. The electrostatic latent image formed on the photosensitive drum 11K is developed by the development device 14K, and thus, a developer image is formed on the photosensitive drum 11K. Similar to the image forming part 10K, developer images are formed on the respective photosensitive drums 11Y, 11M and 11C in the other image forming parts 10Y, 10M and 10C.

The print medium P sent to the transfer belt 31 is carried in the arrow A2 direction in accordance with the traveling of the transfer belt 31 due to the control of the image formation controller 200 and sequentially passes the image forming parts 10K, 10Y, 10M and 10C. At this time, each of the transfer rollers 34K, 34Y, 34M and 34C transfers the developer image of the respective color formed on the photosensitive drums 11K, 11Y, 11M and 11C onto the print medium P on the transfer belt 31. As a result, the developer image of the respective colors is transferred onto the print medium P while being sequentially superimposed, and thereby a color developer image is formed. The developer remained on the photosensitive drums 11K, 11Y, 11M and 11C after the transfer is respectively scraped by the cleaning devices 15K, 15Y, 15M and 15C. The surface of the photosensitive drums 11K, 11Y, 11M and 11C after the cleaning is serviced for the next charging. The print medium P on which the developer image has been formed is carried from the transfer belt 31 to the fusion device 100.

In the fusion device 100, electric current flows to the resistance wire 122 of the heater 120 based on the control by the image formation controller 200 so as to obtain a heat amount that is enough for the fusion device 100 to thermally compress and bond the developer image formed on the print medium P. Thereby, the heater 120 generates heat. In addition, at the same time when the heater 120 generates heat, the fusion roller 150 starts rotating as a motive force from the drive system (not shown) is received as a result of the control by the image formation controller 200. Operating together with the rotation of the fusion roller 150, the belt 110 and the pressure application roller 170 also start rotating. The heat generated from the heat 120 is transmitted to the heat transmission member 130 through the heat transmissive grease 192 and the heater contact surface 130*c* of the heat transmission member 130 and is transmitted to the belt 110 from the heat transmission member 130. As a result, the belt 110 is heated. The part of the belt 110 that is heated by the heat transmission member 130 is carried to the nip region N in accordance with the rotation of the belt 110.

As shown in FIG. 2, the print medium P from the transfer belt 31 is carried in the arrow A6 direction and is carried to the nip region N of the fusion device 100. When the print medium P passes through the nip region N, the developer image D formed on the print medium P is thermally compressed and bonded by the heated belt 110 in the nip region N.

The print medium P that has been thermally compressed and bonded in the nip region N is carried by the medium carrying rollers 51 to the ejected sheet stacking part 53 through the print medium ejection opening 52.

In the heat transmission member 130, when the heating by the heater 120 is performed, a temperature of the first member 131 that faces the resistance wire 122 (or the resistance wires 122 and 125) reaches higher compared with the second member 132 and the third member 133 that regulate the end parts of the heater 120.

[Opening Parts of Heat Transmission Member]

Figure 8A:
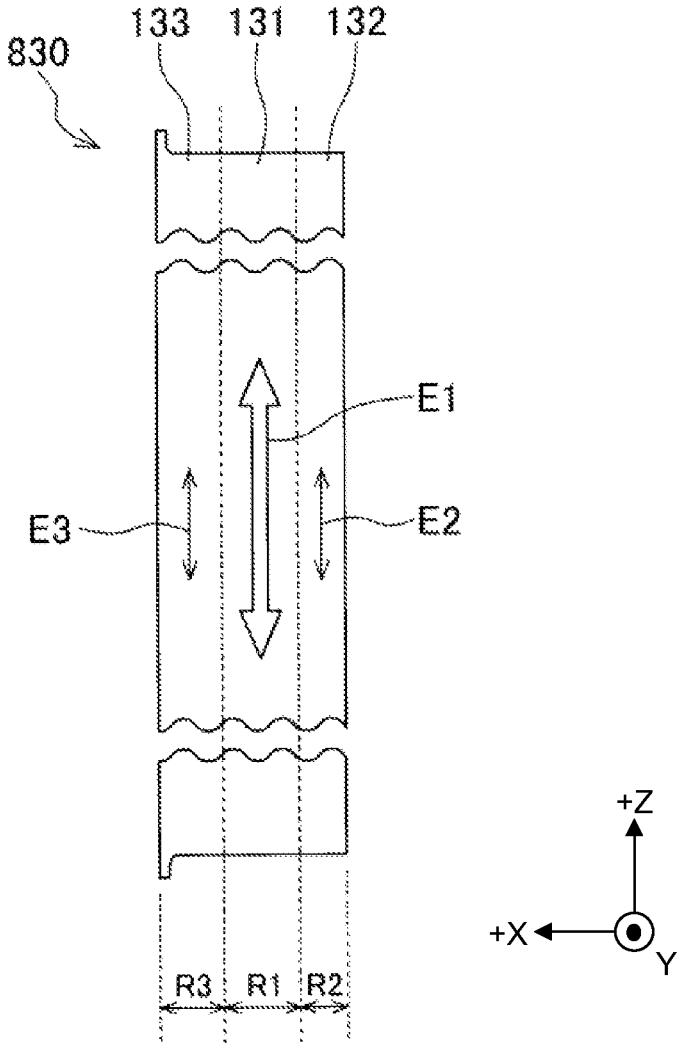
FIGS. 8A and 8B are diagrams illustrating a heat transmission member of a comparative example.
Figure 8B:
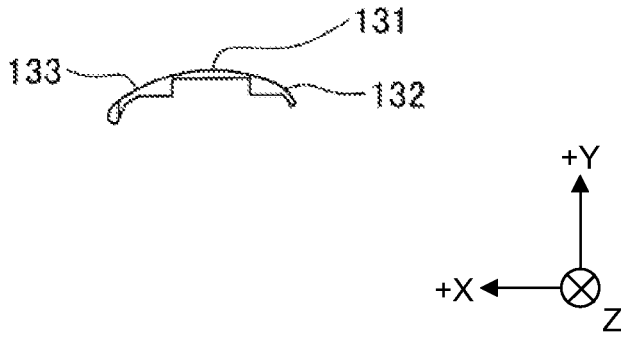
Figure 9:
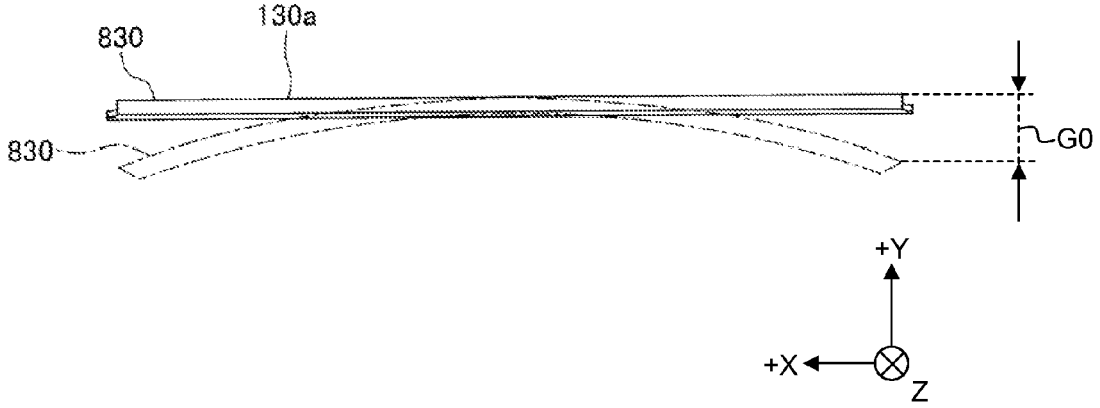
FIG. 9 is a diagram illustrating an example of heat deformation of the heat transmission member of the comparative example.

Next, the opening parts of the heat transmission member 130 are explained next. FIGS. 8A and 8B are diagrams illustrating a heat transmission member 830 of a comparative example. FIG. 8A is a top view, and FIG. 8B is a side view. FIG. 9 is a diagram illustrating an example of heat deformation of the heat transmission member 830 of the comparative example. In FIG. 9, solid lines indicate the heat transmission member 830 before the deformation, and single dot chain lines indicate the heat transmission member 830 after the deformation. Except the point that opening parts are not provided, the heat transmission member 830 of the comparative example is similar to the heat transmission member 130 of the first embodiment. In FIGS. 8A, 8B and 9, the same symbols are referenced to parts that are similar to those of the heat transmission member 130 of the first embodiment.

First, a case in which the heat transmission member 830 of the comparative example, to which the opening parts are not provided, is used is explained with reference to FIGS. 8A, 8B and 9. Compared to the first member 131, the second member 132 and the third member 133 are located at positioned farther from the heating surface 120*a* that functions as a heating part (or the resistance wire 122 that functions as a heating body), and the heat mount that the second member 132 and the third member 133 receive from the heater is smaller. As a result, when the heat transmission member 830 is heated by the heater 120, the temperature of the first member 131 becomes higher than the temperature of the second member 132 and the third member 133. Therefore, the first member 131 expands larger than the second member 132 and the third member 133. The deformed amount in the thickness direction (or Y direction) is shown with G0 in FIG. 9. In FIG. 8A, the arrows E1, E2 and E3 indicate heat expansion of the first member 131, the second member 132 and the third member 133. The length of each arrow represents the amount of heat expansion. If there is a difference in the amount of heat expansion between the second member 132/the third member 133 and the first member 131, the second member 132 and the third member 133, which have smaller amount of heat expansion compared to the first member 131, are not displaced together with the first member 131 when the first 131 having a larger amount of heat expansion is displaced due to the heat expansion. Therefore, the heat transmission member 830 is unevenly deformed. As a result, the belt contact surface 130*a* formed by the first member 131, the second member 132 and the third member 133 is in an uneven state with respect to the belt 110. For instance, although it depends on the shape of the heat transmission member 830 and the like, warping occurs so that the center side of the heat transmission member 830 is positioned closer to the belt 110 than both end sides of the heat transmission member 830 in the longitudinal direction thereof as shown in FIG. 9. In other words, deformation occurs that causes the both end parts of the heat transmission member 830 in the longitudinal direction to peel away from the belt 110.

Figure 10A:
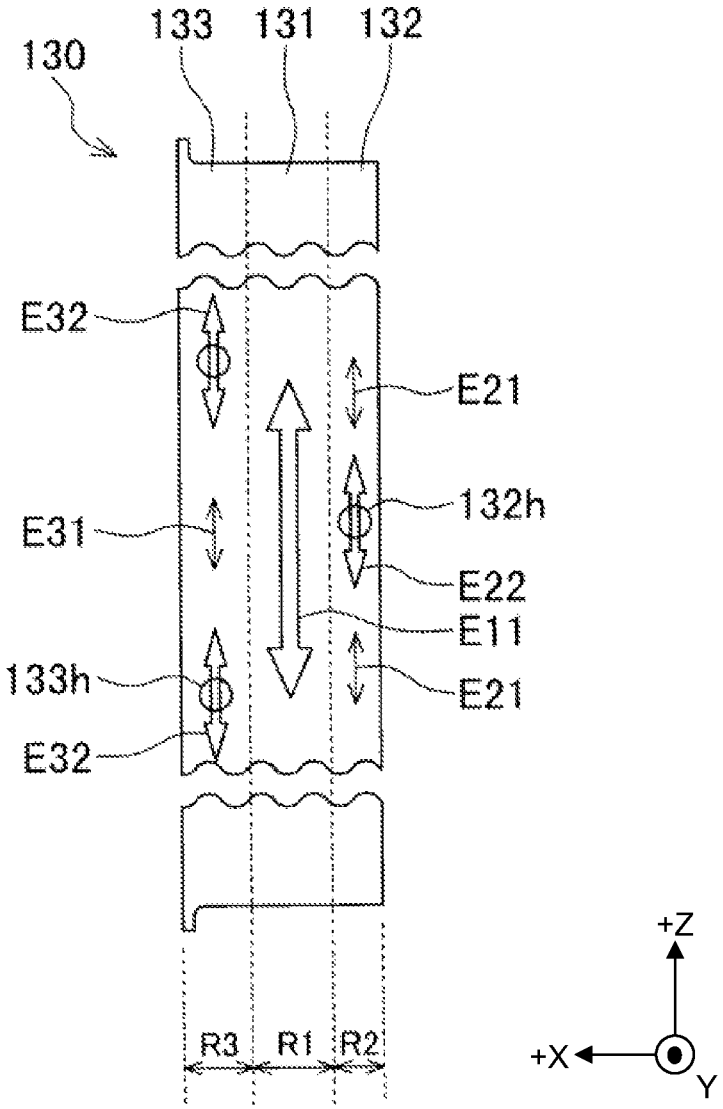
FIGS. 10A and 10B are diagrams illustrating the heat transmission member of the first embodiment.
Figure 10B:
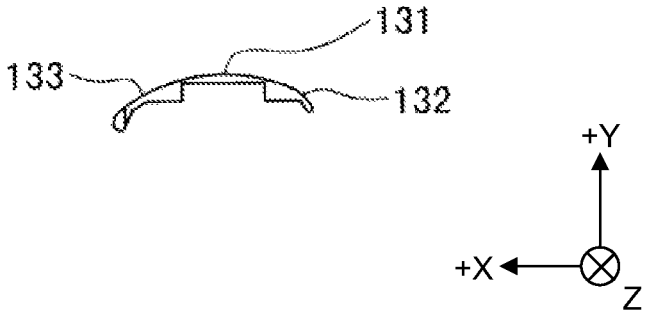
Figure 11:
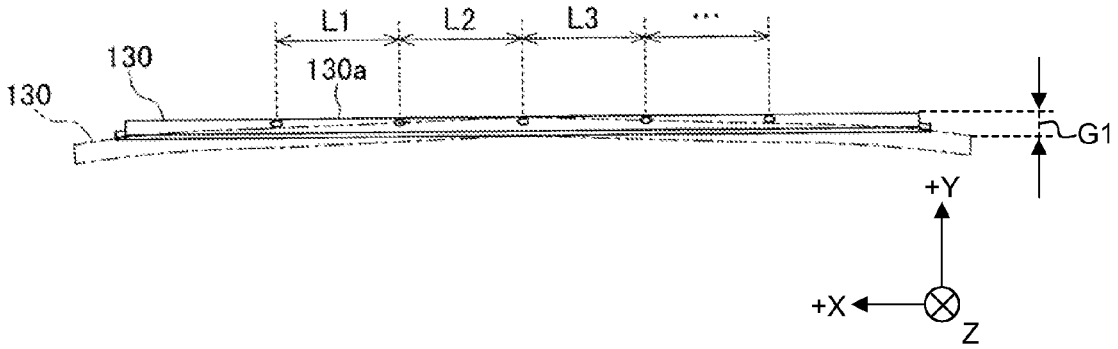
FIG. 11 is a diagram illustrating an example of heat deformation of the heat transmission member of the first embodiment.

FIGS. 10A and 10B are diagrams illustrating the heat transmission member 130 of the first embodiment. FIG. 10A is a top view, and FIG. 10B is a side view. FIG. 11 is a diagram illustrating an example of heat deformation of the heat transmission member 130 of the first embodiment. In FIG. 1, solid lines indicate the heat transmission member 130 before the deformation, and single dot chain lines indicate the heat transmission member 130 after the deformation. The deformed amount in the thickness direction (or Y direction) at both end parts of the heat transmission member 130 (the end parts means terminal parts in the longitudinal direction (or X direction)) is shown with G1 in FIG. 11. The heat transmission member 130 of the present embodiment is explained below with reference to FIGS. 10 and 11.

From a view point to reduce the uneven deformation of the heat transmission member, holes 132*h* and holes 133*h* are provided as the respective opening parts to the second member 132 and the third member 133 in the heat transmission member 130 of the present embodiment. In this case, rigidity is reduced in the vicinity of the holes 132*h* and the holes 133*h* and causes displacement around the holes 132*h* and the holes 133*h* together with the heat deformation of the first member 133, which reaches the highest temperature, as shown in FIG. 10A. In FIG. 10A, arrows E11, E21, E31, E22 and E32 respectively indicate heat expansion in the first member 131, a part not in the vicinity of the holes 132*h* of the second member 132, a part not in the vicinity of the holes 133*h* of the third member 133, a part in the vicinity of the hole 132*h* of the second member 132, and a part in the vicinity of the holes 133*h* of the third member 133. The length of each arrow represents the amount of heat expansion.

Due to the displacement in the vicinity of the opening parts, the difference of the amounts of heat expansion between the second member 132/the third member 133 and the first member 131 is reduced, and thereby, uneven deformation of the heat transmission member 130 is avoided or reduced. For example, as shown in FIG. 11, even if the first member 131 reaches a high temperature compared with the second member 132 and the third member 133, the deformation that causes the both end parts of the heat transmission member 130 in the longitudinal direction to separated significantly away from the belt 110 does not occur. Instead, deformation that causes the length of the heat transmission member 130 in the longitudinal direction to increase occurs. As a result, a state in which the heat transmission member 130 is pressed against the belt 110 is maintained, and the heat from the heat transmission member 130 is stably (or evenly) transmitted to the belt 110.

Here, the opening parts are provided so that the difference in the amounts of heat expansions between the members (between the first member and the second member and between the first member and the third member) in the longitudinal direction and thereby that the uneven deformation of the heat transmission member 130 is reduced. Shapes, numbers, positions and the like of the opening parts may be appropriately determined. To put other way, it is practical to align multiple opening parts that are identical, or to arrange several types of opening parts, which have different shapes, regularly or randomly. In the embodiment, a deformed amount G1 was measured with a height gauge under conditions that are at a room temperature (23° C.±2° C.), a regular humidity (50±5%) and at 5 second after the heater 120 was turned on, the belt 110 being mainted not driven. In the measurement, the timing of the measure was 5 second after the heater turing on. The timing, however, is not limited to this. As long as a deformed amount ratio ⊿G1 per one second is within 10% with respect to the total deformaed amount that has occurred after the heater turning on, the timing can be adjustable considering the quick heating capabitity of the heater 120. Also, a length Lx of the heat transmission member 130 in the longitudinal direction (see FIG. 5A) was set 344.6 mm. Since the deformed amount G1 that was meatured in the thickness direction was 0.379 mm, the percentage with respect to the length Lx was 0.11%. In a pracitical view, it is preferred that the deformed amount G1 is set to fall within a range from 0% to 0.6%.

In the present example, the second member 132 includes a plurality of the holes 132*h* along the longitudinal direction thereof. The third member 133 includes a plurality of the holes 133*h* along the longitudinal direction thereof. Moreover, the plurality of the holes 132*h* are arranged at approximately equal pitch (or interval) in the longitudinal direction of the second member 132. The plurality of the holes 133*h* are arranged at approximately equal pitch in the longitudinal direction of the third member 133. Here, when the pitches of the adjacent holes are defined as L1, L2, L3 . . . , the approximately equal pitch means that pitches L2, L3, . . . are within a range of 70-130% of pitch L1. The pitch L1 is defined from the far end hole in the longitudinal direction. Further, the holes 132*h* and 133*h* are through holes, and more specifically, holes that penetrate between the belt contact surface 130*a* and the back surface 130*b* in a thickness direction of the heat transmission member 130.

Assuming that the holes 132*h* of the second member 132 and the holes 133*h* of the third member 133 are respectively arranged at positions in the same lines in the belt moving direction, certain regions of the belt 110 pass over the holes or vicinity of the holes of the both members. Therefore, the heat transmission is possibly uneven. For example, in the above-described specific regions of the belt 110, the contact surface between the belt 110 and the heat transmission member 130 is significantly reduced. Thus, there is a possibility that significantly uneven temperature occurs in the longitudinal direction of the belt 110.

Figure 12:
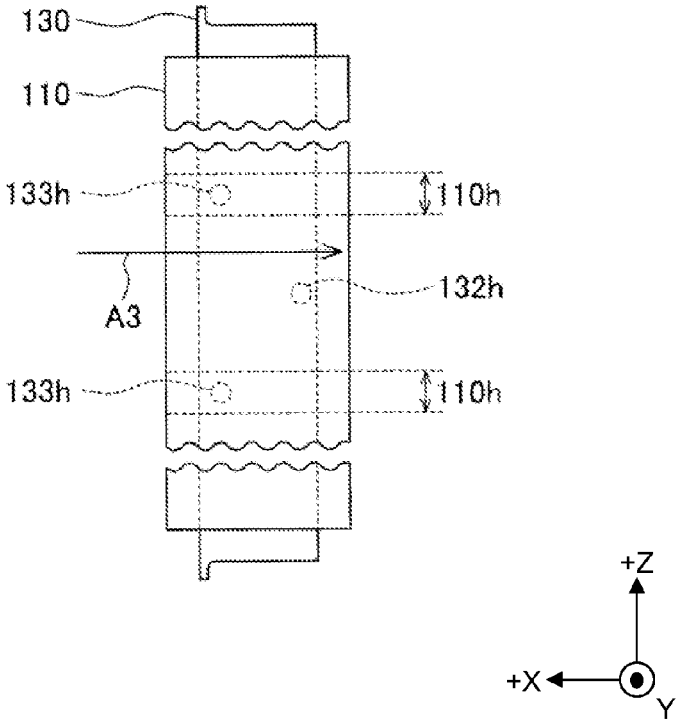
FIG. 12 is a diagram for explaining arrangement of holes of a first member and holes of a second member.

From a view point to prevent the above-described uneven heat transmission and the uneven temperature, the holes 132*h* of the second member 132 and the holes 133*h* of the third member 133 are arranged so as not to be positioned in on the same line in the belt moving direction (so as not to overlap the region of the holes 132*h* and the regions of the holes 133*h* in the belt moving direction) in the present example, as shown in FIGS. 5A, 5B and 12. In this case, as shown in FIG. 12, regions 110*h* of the belt 110 that pass over the holes 133*h* of the third member 133 or the vicinity thereof do not pass over the holes 132*h* of the second member 132 or the vicinity thereof. As a result, negative effects (e.g., uneven heat transmission and/or uneven temperature) due to the specific areas of the belt 110 that passes above the holes of both members or the vicinity thereof are reduced.

Moreover, in the present example, as shown in FIGS. 5A, 5B and 12, the holes 132*h* formed in the second member 132 and the holes 133*h* formed in the third member 133 are arranged in a checked pattern (or in alternating manner) in the longitudinal direction of the heat transmission member 130. In FIG. 12, the holes 132*h* and the holes 133*h* are arranged so that the pitch of the adjacent holes 132*h* and holes 133*h* are approximately equal in the longitudinal direction of the heat transmission member 130.

With the fusion device 100 that includes the heat transmission member 130 in which the opening parts are provided, the belt 110 is pressed against the heat transmission member 130 in the entire area in the longitudinal direction thereof. Therefore, the belt 110 carried to the nip region N after being heated so as to have an excellent temperature distribution in the longitudinal direction. Thereby, the heat compression and bonding of the developer image formed on the print medium P is performed in the nip region N.

[Specific Example of Fusion Device]

A specific example of the fusion device 100 is described below. An inner diameter of the belt 110 is ϕ45 [mm] The belt 110 includes a polyimide base layer having a thickness of 0.1 [mm], a silicone rubber elastic layer having a thickness of 0.2 [mm] formed on the outer circumference of the belt 110, and a PFA tube layer formed on the yet outer circumference of the belt 110.

The heater 120 is configured form a glass protective layer 124, a silver-palladium alloy resistance wire 122 having a wire width of 3 [mm], and a glass protective layer 123 sequentially stacked on a base as a stainless (SUS) base 121 having a length of 350 [mm], a width of 10 [mm] and a thickness of 0.6 [mm]. In addition, output of the resistance wire 122 is 1200 [W].

Figure 13:
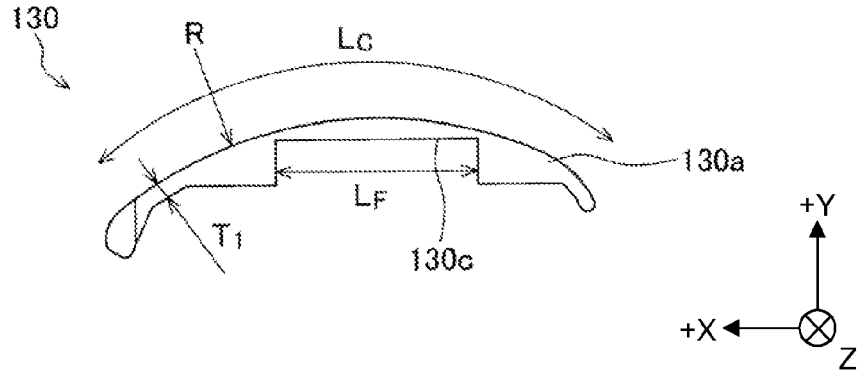
FIG. 13 is a diagram illustrating a side surface shape of the heat transmission member.

The material of the heat transmission member 130 is A6063, which is extruded form of aluminum. As shown in FIG. 13, the heat transmission member 130 is in a partially cylindrical shape. A thickness $T_1$ of the heat transmission member 130 is approximately 1 [mm]. A curvature radius R of the belt contact surface 130*a*, which is a curved part, is 25 [mm]. A width $L_c$ of the belt contact surface 130*a* is 30 [mm]. A width $L_F$ of the heater contact surface 130*c*, which is a planar part, is 10.2 [mm]. A diameter of the holes 132*h* and the holes 133*h* is 4 [mm] The plurality of the holes 132*h* are linearly arranged with a pitch of approximately 50 [mm] in the longitudinal direction of the second member 132. The plurality of the holes 133*h* are linearly arranged with a pitch of approximately 50 [mm] in the longitudinal direction of the third member 133. The plurality of the holes 132*h* and the plurality of the holes 133*h* are arranged in a checked pattern in the longitudinal direction of the heat transmission member 130. In the embodiment above, the thickness T1 is defined as a thickness of the thinnest portion of the third member in FIG. 13. However, another thickness which represents the heat transmission member may be useful. For example, that may be an average thickness of the heat transmission member 130 that is calculated by dividing an entire sectional area by the width Lc of the belt contact surface 130*a*. Another average thickness of one of the first, second and third members as well may be useful to represent the heat transmission member.

The heat transmissive grease 192 is made by mixing zinc oxide powder in silicone oil to increase heat transmissitivity.

The pressure application plate 193 is made of aluminum (A5052) having a length of 350 [mm], a width of 10 [mm] and a thickness of 2.0 [mm].

The spring 140, which is an elastic member, evenly presses the pressure application plate 193 in the +Y direction at a pressure application force of a total of 4 [kgf].

An outer diameter of the fusion roller 150 is ϕ25 [mm]. The elastic layer 152 of the fusion roller 150 is a silicone sponge. A thickness of the elastic layer 152 is 2 [mm]

The material of the pressure application pad 160 is A6063, which is an extruded form of aluminum. The pressure application pad 160 includes an elastic layer having a thickness of approximately 1 [mm] made of silicone rubber formed on a contact surface with the belt 110. To the pressure application pad 160, a pressure application force of 3.5 [kgf] is applied in the −Y direction by the spring 194 as an elastic member.

An outer diameter of the pressure application roller 170 is ϕ35 [mm]. The elastic layer 172 of the pressure application roller 170 is a silicone sponge. A thickness of the elastic layer 172 is 2 [mm]. The outer circumference layer of the elastic layer 172 is configured with a PFA tube. In addition, a pressure application force of 20 [kgf] is applied to both ends of the core part 171 of the pressure application roller 170 in the +Y direction by a pressure application member (not shown).

In the embodiment, the holes 133*h* are in a circular shape, of which diameters ϕ are 4 mm. In the practical light, it is not necessary for the all of the diamters ϕ to be identical, or to be circular. An ellipse and oval shape can be used. These shapes are defined as substantially circular in the invention. In the downstream region R2, a length $L_F$2 that is defined between the regulation surface 132*b* and a downstream end 132*p* in the belt carrying direction is 7 mm. The length $L_F$2 may be defined as a second member width ($L_F$2) which corresponds to a width of the second member 132. In the upstream region R3, a length $L_F$3 that is defined between the regulation surface 133*b* and an upstream end 133*p* in the belt carrying direction is 10 mm. The length $L_F$3 may be defined as a third member width ($L_F$3) which corresponds to a width of the third member 133. Herein, the diameters ϕ is 57% with respect to the length $L_F$2. The diameters ϕ is 40% with respect to the length $F_L$3. A length W130 is 29.4 mm, which is 8.5% with respect to a length Lx. The diameters ϕ can be measured in the BMD when the holes are oval or rectangle other than circular. It is preferred that the W130 is set to be within a range from 5% to 15% with respect to the length Lx. It is preferred that the diameters ϕ are set to be within a range from 20% to 70% with respect to either the length $L_F$2 or length $L_F$3, or both of the length $L_F$2 and length $L_F$3. A certain amount of the advantage may be obtain by respectively arranging three or more of the holes 133*h* and holes 132*h* in the longitudinal direction of the heat transmission member 130. It is preferred that the pitch L1 of the holes 133*h* is set to be within a range from 5% to 20% with respect to the length Lx of the heat transmission member 130 in the longitudinal direction. In the embodiment, the pitches L1, L2, L3 between the holes 133*h* are arranged with the substantially same intervals. Even when the pitches L1, L2 are within a range from 30% to 170% with respect to the length L1, a certain amount of the advantage can be obtained.

[Evaluation of Fusion Device]

The fusion device of the first embodiment and the fusion device of a comparative example were compared. In this evaluation, a fusion device that has the configuration described in the above specific example was used as the fusion device of the first embodiment. In addition, a heat transmission member in which hole pats are not provided was used as the fusion device of the comparative example. Other conditions of the fusion device were the same as the fusion device of the first embodiment.

For this evaluation, temperature of an end part of the belt and a fusion ratio were measured. More specifically, by attaching thermistors at a center part in the longitudinal direction of the belt 110 and the end part located 150 [mm] away from the center part, measurement of temperature at the center part and the end part of the belt 110 was enabled. Then, in a state where all of the members of the fusion device was at 25[° C.], electric current was applied to the resistance wire 122 of the heater 120. At the same time, a drive force was applied to the fusion roller 150 to rotate the fusion roller 150, the belt 110 and the pressure application roller 170. The measured temperature at the center part of the belt 110 first reached 160[° C.], which is the temperature at which the developer image on the print medium is fusible preferably, the temperature at the end part of the belt 110 was measured. In addition, an A4 sheet print medium was carried in a landscape feeding to the nip region N at a print speed of 35 [ppm], and the fusion ratio of the developer image on the print medium was measured.

Here, the fusion ratio is explained. A solid image in each color is formed using the four color (CMYK) toner as the developer on, and fused to, the print medium. Density Nb of the developer image of each color that is fused to the print medium is measured. Thereafter, a predetermined adhesive tape is attached to the top of the developer image of each color. Then, after closely adhering the developer image and the adhesive tape by applying a weight of 500 [g], the adhesive tape is peeled off, and density Na of the developer image of each color is again measured. Using the density values Nb and Na as measured above, a fusion ratio is calculated based on the below equation. Fusion Ratio=(Na/Nb)×100 [%]

In this evaluation, the developer image of each color was formed on and fused to positions of the print medium that respectively correspond to thermistors at the longitudinal direction center part and the longitudinal direction end part. Then, the fusion ratio of the developer image of each color is measured at the center part and the end part.

If the fusion ratio is below 70%, a part of the developer image is peeled off from the print medium and is attached to the user's finger if the user touches with his/her finger the developer after the fusion. Therefore, from a view pint for excellent fixation, it is necessary to secure the fusion ratio of 70% or more.

Evaluation results of each fusion device are shown in below Table 1.

TABLE 1

| Fusion Device | Belt Center Part Temperature | Belt End Part Temeprature | Temp. Diff. (Center – End Part) | Fusion Ratio at End Part |
|---|---|---|---|---|
| First Embodiemnt | 160 [° C.] | 155 [° C.] | 5 [° C.] | 86-93 [%] |
| Comparative Example | 160 [° C.] | 146 [° C.] | 14 [° C.] | 72-79 [%] |

Table 1 shows the "belt center part temperature," which is measured temperature of the center part of the belt 110, a "belt end part temperature," which is the measured temperature of the end part of the belt 110, a "temperature difference (center part–end part)," which is a difference of the belt center part temperature and the belt end part temperature, and a "end part fusion ratio," which is the fusion ratio of the developer image of each color at the end part, for each of the fusion device of the first embodiment and the fusion device of the comparative example. In the "end part fusion ratio," a range of the fusion ratio of the developer images of four colors is shown. Moreover, although not shown in Table 1, the fusion ratio of the developer image of each color at the center part was 96-100 [%] in both of the fusion devices of the first embodiment and the comparative example.

As shown in Table 1, the temperature difference between the belt center part and the belt end part was 14 [° C.] with the fusion device of the comparative example while 5 [° C.] with the fusion device of the first embodiment. Therefore, the temperature difference in the longitudinal direction decreased by 9 [° C.] compared with the comparative example. The fusion ratio at the end part was 72-79 [%] with the fusion device of the comparative example while 86-93 [%] with the fusion device of the first embodiment. Therefore, the fusion ratio increased compared with the comparative example. This is because the temperature at the belt end part is high in the fusion device of the first embodiment, causing the developer image to be more easily thermally fused.

The 72-79 [%] fusion ratio at the end part in the fusion device of the comparative example was is higher than 70%, which is an evaluation reference. However, the lower end of fluctuations was close to 70 [%], and thus, the margin was very small. In contrast, the 86-93 [%] fusion ratio at the end part in the fusion device of the first embodiment was significantly higher than 70 [%], which is the evaluation reference. Therefore, it is understood that a stable fixation was accomplished.

[Advantages]

According to the first embodiment discussed above, the following advantages (1) to (4) are achieved:

(1) In the present embodiment, in the fusion device that includes a heating member having a heating part and a heat transmission member that contacts with the heating member, the heat transmission member includes a first member that transmits the heat from the heating part by contacting with the heating part of the heating member and a second member that regulates the position of the heating member, and the second member includes opening parts. According to the present embodiment, uneven deformation of the heat transmission member is reduced. More specifically, the difference in the amount of heat expansion between the first member and the second member is reduced by deformation of the vicinity of the opening parts of the second member. Therefore, deformation of the heat transmission member due to the difference between the about of heat expansion between the first and second members is reduced. Accordingly, the heat from the heating member is uniformly transmitted from the heat transmission member to the heated body (e.g., belt), for example, and thereby excellent fixation by the heated body is achieved. For instance, uneven temperature on the belt in the longitudinal direction is reduced, for example. Therefore, excellent fixation of the entire print medium in the longitudinal direction is achieved.

(2) The second member includes a plurality of hole members, and the plurality of hole members are arranged at an approximately equal pitch in the longitudinal direction of the second member. According to this form, uneven deformation of the heat transmission member is more preferably reduced. For example, because the vicinity of the plurality of opening parts is deformed, the amount of the entire deformation is increased compared to the case where the vicinity of a single opening part is deformed. Therefore, the difference in the amount of heat expansion between the members is reduced. Moreover, for example, the plurality of opening parts are arranged at an approximately equal pitch in the longitudinal direction. Therefore, the second member is deformed more evenly in the longitudinal direction.

(3) The fusion device includes a belt that moves by contacting the heat transmission member. The heat transmission member includes a third member that is positioned on the upstream side of the second member over the first member in the belt moving direction and that regulates the position of the heating member. The third member includes opening parts, and the opening parts formed on the second member and the opening parts formed on the third member are not position on the same lines in the belt moving direction. According to this form, uneven heat transmission or uneven temperature on the belt in the longitudinal direction due to certain regions of the belt passing the opening parts of both the second member and the third member are prevented.

(4) The fusion device includes a belt that moves by contacting with the heat transmission member. The heat transmission member includes a third member that is positioned on the upstream side of the second member over the first member in the belt moving direction and that regulates the position of the heating member. The third member includes a plurality of opening parts, and the opening parts formed on the second member and the opening parts formed on the third member are arranged in a checked pattern in the longitudinal direction of the heat transmission member. According to this form, in a configuration that the heat transmission member includes the third member, uneven deformation of the heat transmission member is more preferably reduced. For example, because the vicinity of the plurality of opening parts on the third member is deformed, the amount of the deformation of the entire third member is increased compared to the case where the vicinity of a single opening part is deformed. Therefore, the difference in the amount of heat expansion between members is reduced. Moreover, the opening parts of the second member and the hole members of the third member are arranged in the checked pattern in the longitudinal direction of the heat transmission member. Therefore, certain regions of the belt do not pass through the opening parts of both the second member and the third member. As a result, uneven heat transmission or uneven temperature on the belt in the longitudinal direction due to certain regions of the belt passing the opening parts of both the second member and the third member are prevented.

Second Embodiment

Figure 14A:
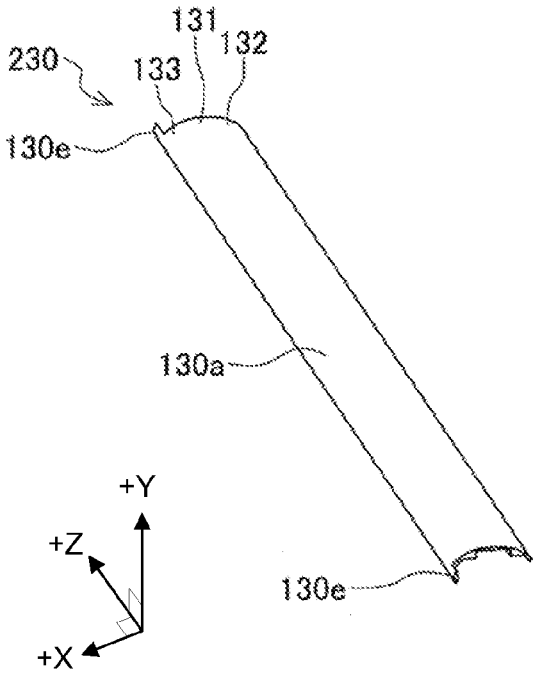
FIGS. 14A and 14B are perspective views illustrating a configuration of a heat transmission member in a second embodiment.
Figure 14B:
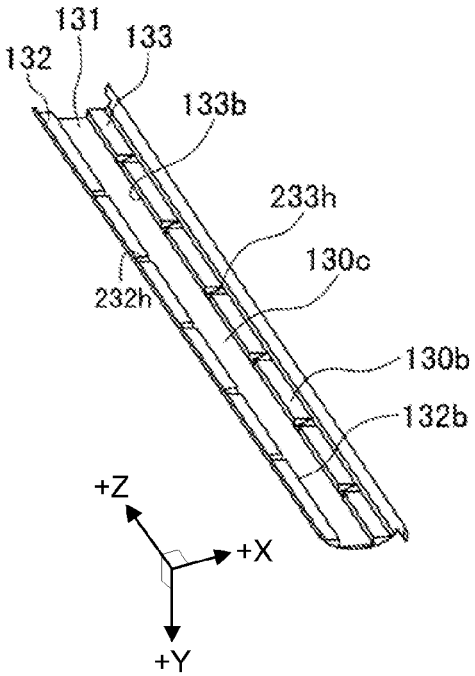

FIGS. 14A and 14B are perspective views illustrating a configuration of a heat transmission member 230 in a second embodiment. FIG. 14A is a view seen from a belt 110 side, and FIG. 14B is a view seen from an opposite side of the belt 110. The heat transmission member 230 according to the second embodiment is explained below with reference to FIGS. 14A and 14B. The heat transmission member 230 includes opening parts with different shapes compared with the heat transmission member 130 according to the first embodiment. Moreover, the heat transmission member 230 is used as an alternative of the heat transmission member 130 in the fusion device 100 and the image forming apparatus 1 of the first embodiment. In the below explanation, parts that are similar to those in the first embodiment are referenced by the same symbols, and explanation of the parts is omitted or simplified.

For the heat transmission member 230 according to the present embodiment, the shape of the opening parts formed on the second member 132 and the third member 133 is a groove shape.

In the example shown in FIGS. 14A and 14B, the second member 132 includes a plurality of grooves 232*h* along the longitudinal direction thereof, and the third member 133 includes a plurality of grooves 233*h* along the longitudinal direction thereof. In addition, the plurality of the grooves 232*h* are arranged at an approximately equal pitch in the longitudinal direction of the second member 132, and the plurality of grooves 233*h* are arranged at an approximately equal pitch in the longitudinal direction of the second member 133. Moreover, the grooves 232*h* and 233*h* are formed on the back surface 130*b* of the heat transmission member 230. Further, the grooves 232*h* and 233*h* are formed so as to cut out the regulation surface 132*b* and 133*b*, respectively. Furthermore, the grooves 232*h* formed on the second member 132 and the grooves 233*h* formed on the third member 133 are arranged not to be positioned on the same line along the belt moving direction. Yet furthermore, the grooves 232*h* formed on the second member 132 and the grooves 233*h* formed on the third member 133 are arranged in the checked pattern (or alternating manner) in the longitudinal direction of the heat transmission member 230. In FIG. 14B, the grooves 232*h* and the grooves 233*h* are arranged so that the pitches of the adjacent grooves 232*h* and the grooves 233*h* are approximately equal in the longitudinal direction of the heat transmission member 230.

As described above, in the heat transfer member 230 of the present embodiment, the grooves 232*h* and the grooves 233*h* are provided as opening parts on the second member 132 and the third member 133. Therefore, rigidness decreases in the vicinity of the grooves 232*h* and the grooves 233*h*. As a result, the vicinity of the grooves 232*h* and the grooves 233*h* deforms following the heat expansion of the first member 131, which turns the highest temperature. Due to the deformation in the vicinity of the grooves, the difference in the amount of heat expansion between the second member 132/the third member 133 and the first member 131. Therefore, uneven deformation of the heat transmission member 230 is reduced. For example, even when the first member 131 turns high temperature compared with the second member 132 and the third member 133, deformation that causes both end parts in the longitudinal direction of the heat transmission member 230 to be significantly peeled off from the belt 110 does not occur, but deformation that causes the length of the heat transmission member 230 in the longitudinal direction to increase occurs. As a result, the heat transmission member 230 is maintained in a state to contact with the belt 110, and the heat of the transmission member 230 is transmitted stably (and evenly) to the belt 110 in the longitudinal direction.

Moreover, in the heat transmission member 230 of the present embodiment, the grooves 232*h* and 233*h* are not included in the belt contact surface 130*a* that is pressed against the belt 110. The belt contact surface 130*a* is a surface without the opening parts (holes, grooves, etc.), and therefore, negative effects due to the presence of the opening parts (holes, grooves, etc.) on the belt contact surface 130*a* are prevented. For example, uneven heat transmission and uneven temperature on the belt 110 are reduced. In addition, for example, because the belt 110 does not pass over the opening parts, the belt 110 is evenly and stably pressed against the heat transmission member 230, and thus, wearing and deformation of the belt 110 are reduced.

According to the second embodiment as explained above, the below advantage (5) is achieved in addition to the above advantages (1)-(4). (5) The opening parts are in a groove shape and are not provided on the surface of the heat transmission member that contacts with the heated body (e.g., belt). According to this form, negative effects due to the presence of the opening parts on the surface of the heat transmission member that contacts the heated body are avoided. For example, compared with the case in which the opening parts are provided on the belt contact surface, the heat is evenly transmitted from the heat transmission member to the belt, and thereby, uneven temperature in the longitudinal direction of the belt is reduced. As a result, excellent fixation in the entire area of the print medium in the longitudinal direction is achieved. Moreover, the heat transmission member and the belt are evenly and stably pressed against each other. Therefore, wearing and deformation of the belt are reduced, resulting in allowing a long use. Accordingly, a fusion device with excellent durability is realized.

Third Embodiment

Figure 15A:
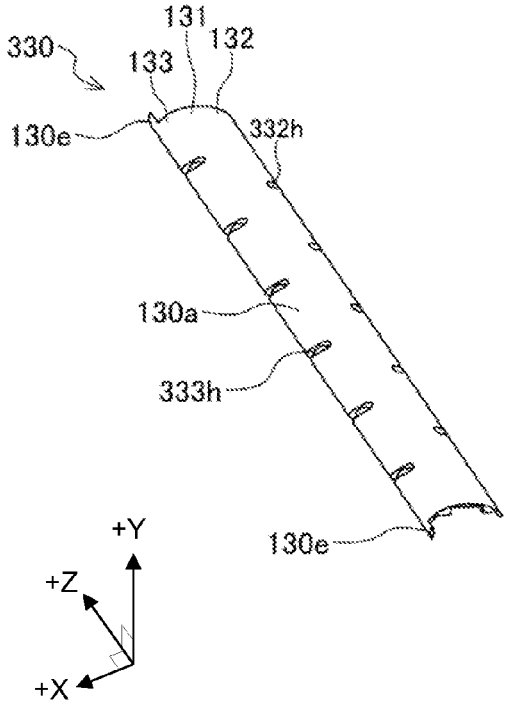
FIGS. 15A and 15B are perspective views illustrating a configuration of a heat transmission member in a third embodiment.
Figure 15B:
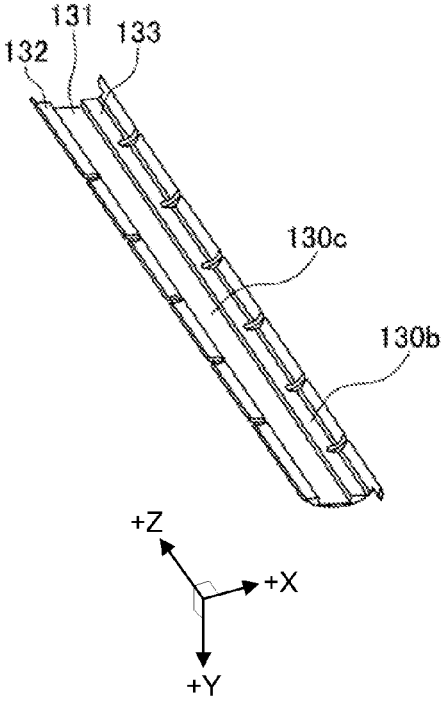

FIGS. 15A and 15B are perspective views illustrating a configuration of a heat transmission member 330 according to a third embodiment. FIG. 15A is a view seen from a belt 110 side, and FIG. 15B is a view seen from an opposite side of the belt 110. The heat transmission member 330 according to the second embodiment is explained below with reference to FIGS. 15A and 15B. The heat transmission member 330 includes opening parts with different shapes compared with the heat transmission member 130 according to the first embodiment. Moreover, the heat transmission member 330 is used as an alternative of the heat transmission member 130 in the fusion device 100 and the image forming apparatus 1 of the first embodiment. In the below explanation, parts that are similar to those in the first embodiment are referenced by the same symbols, and explanation of the parts is omitted or simplified.

For the heat transmission member 330 according to the present embodiment, the shape of the opening parts formed on the second member 132 and the third member 133 is a cutout shape.

In the example shown in FIGS. 15A and 15B, the second member 132 includes a plurality of cutouts 332*h* along the longitudinal direction thereof, and the third member 133 includes a plurality of cutouts 333*h* along the longitudinal direction thereof. In addition, the plurality of the cutouts 332*h* are arranged at an approximately equal pitch in the longitudinal direction of the second member 132, and the plurality of cutouts 333*h* are arranged at an approximately equal pitch in the longitudinal direction of the second member 133. Moreover, the cutout parts 332*h* have a shape that is cut through the heat transmission member 330 in the thickness direction thereof between the bet contact surface 130*a* and the back surface 130*b* and that is open on the downstream side in the belt moving direction. The cutout parts 333*h* have a shape that is cut through the heat transmission member 330 in the thickness direction thereof between the bet contact surface 130*a* and the back surface 130*b* and that is open on the upstream side in the belt moving direction. That is, the cutout parts 332*h* have a shape in which the end part of the heat transmission member 330 on the downstream side in the belt moving direction is cut out, and the cutout parts 333*h* have a shape in which the end part of the heat transmission member 330 on the downstream side in the belt moving direction is cut out. Further, the cutout parts 332*h* formed on the second member 132 and the cutout parts 333*h* formed on the third member 133 are arranged not to be positioned on the same line along the belt moving direction. Furthermore, the cutout parts 333*h* formed on the second member 132 and the cutout parts 333*h* formed on the third member 133 are arranged in the checked pattern (or alternating manner) in the longitudinal direction of the heat transmission member 330. In FIG. 15B, the cutout parts 332*h* and the cutout parts 333*h* are arranged so that the pitches of the adjacent cutout parts 332*h* and the cutout parts 333*h* are approximately equal in the longitudinal direction of the heat transmission member 330.

As described above, in the heat transfer member 330 of the present embodiment, the cutout parts 332*h* and the cutout parts 333*h* are provided as opening parts on the second member 132 and the third member 133. Therefore, rigidness significantly decreases in the vicinity of the cutout parts 332*h* and the cutout parts 333*h*. As a result, the vicinity of the cutout parts 332*h* and the cutout parts 333*h* deforms more than the vicinity of the holes in the first embodiment, following the heat expansion of the first member 131, which turns the highest temperature. Due to the deformation in the vicinity of the cutouts, the difference in the amount of heat expansion between the second member 132/the third member 133 and the first member 131. Therefore, uneven deformation of the heat transmission member 330 is reduced. For example, even when the first member 131 turns high temperature compared with the second member 132 and the third member 133, deformation by which both end parts in the longitudinal direction of the heat transmission member 330 is significantly peeled off from the belt 110 does not occur, but deformation by which the length of the heat transmission member 330 in the longitudinal direction increases occurs. As a result, compared with the heat transmission member 130 in the first embodiment, the heat transmission member 330 is further maintained in a state to contact with the belt 110, and the heat of the transmission member 330 is transmitted stably (and evenly) to the belt 110 in the longitudinal direction.

According to the third embodiment as explained above, the below advantage (6) is achieved in addition to the above advantages (1)-(4). (6) The shape of the opening parts is a cutout shape. According to this form, the amount of deformation in the vicinity of opening parts is creased compared with the case that the opening parts are through holes. As a result, the above advantage (1) is achieved more preferably. For example, the difference in the amount of heat expansion between the members is reduced. Therefore, uneven temperature in the longitudinal direction of the belt is reduced. As a result, better fixation is achieved in the entire area of the print medium in the longitudinal direction.

In the present specification, terms such as "same", "orthogonal", "parallel" and "perpendicular" are not limited to the terms in their strict meaning and include "approximately the same", "approximately orthogonal", "approximately parallel" and "approximately perpendicular," respectively.

Further, the present invention is not limited to the above embodiments and may be implemented in various forms within a scope that does not depart the aspect of the present invention.

For example, in the first to third embodiments, the opening parts formed on the second member 132 and the third member 133 are in the same through holes, grooves and cutouts. However, different combinations may be possible. For instance, through holes may be formed on the second member 132, and grooves may be formed on the third member 133. When the opening parts have an ellipse or oval shape, a dimension of its major axis or minor axis can be used as the diameter to represent the shape of ellipse or oval. Or, a mean value of the dimensions of the major and minor axes also can be used.

Moreover, for example, in the first to third embodiments, the pressure application pad 160 is provided. However, the pressure application pad 160 may be omitted. With the configuration with the pressure application pad 160, the nip region N can be expanded, and thus high-speed printing, for example, is supported.

Further, in the first to third embodiments, the heat transmission member is arranged at a position away from the nip region N. However, the heat transmission member may be arranged at a position corresponding to the nip region N (e.g., position at which the pressure application pad 160 is provided). For example, the heat transmission member may be arranged so as to face the pressure application roller 170 over the belt 110, and thus, the nip region N is formed by the heat transmission member.

Moreover, in the first to third embodiments, the heat transmission member is pressed against the belt 110 from the inner side of the belt 110. However, the heat transmission member may be pressed against the belt 110 from the outer side of the belt 110.

Furthermore, in the first to third embodiments, the pressure application roller 170 is provided to form the nip region N. However, a slide member having a non-roller shape may be provided instead of the pressure application roller 170.

In addition, in the first to third embodiments, the fusion roller 150 is used as a drive source. However, the pressure application roller 170 may be used as a drive source.

A developer of the present invention in general means any materials that embody an electric image (or digital image) on the surface of the print medium. It includes toner which is to be fused on the printing medium by an applied heat and ink that is to be ejected toward the print medium to form an actual image when it becomes dried, or the like. The toner and ink may be chromatic as well as achromatic. There is no limitation regarding its components. For example, thermal fusion materials for the toner and thermal aggregation materials for the ink may be available.

What is claimed is:

1. A fusion device for fusing a developer image on a print medium, comprising:

an endless belt that is driven in an endless belt moving direction to carry the print medium, a sheet shape heating member that is arranged inside the endless belt, generates heat and includes a heating surface from which the heat is conveyed to; and a heat transmission member that is arranged inside the endless belt and has a belt contact surface (130*a*) on which the endless belt runs in a sliding fashion, wherein the heat transmission member is configured with first, second and third members, the first member is positioned between the second and third members in the endless belt moving direction, includes a first surface, which is an opposite from the belt contact surface, contacting the heating surface of the heating member to transmit the heat from the heating member to the endless belt through thereof, and a second member that is positioned at a downstream side from the first member in the endless belt moving direction, having a regulation surface that forms a corner with the first surface of the first member, and the second member including a plurality of opening parts arranged in an rotational axis direction of the endless belt, a third member that is positioned on an upstream side from the first member in the endless belt moving direction, having another regulation surface that form another corner with the first surface of the first member, the third member including a plurality of opening parts arranged in the rotation axis direction of the endless belt on the belt contact surface, and the regulation surfaces and the first surface form a recess in which the heating member is equipped so that a position of the heating member is regulated and no portion of the sheet shape heating member directly contacts to the endless belt, at least some of the opening parts formed in the second member are offset with respect to some of the opening parts formed in the third member in the endless belt moving direction.

2. The fusion device according to claim 1, wherein the opening parts are through holes (132*h*, 133*h*) that penetrate the heat transmission member from the belt contact surface.

3. The fusion device according to claim 2, wherein all of the through holes in the second member are offset with respect to all of the through holes in the third member in the endless belt moving direction.

4. The fusion device according to claim 1, wherein the opening parts of the second member and the third member are grooves (232*h*, 233*h*) that are respectively formed on back surfaces of the second member and third members, the back surfaces being at an opposite side from the belt contact surface.

5. The fusion device according to claim 1, wherein the opening parts of the second member are cutouts (332*h*) that are formed by an edge of the second member encroaching against the endless belt moving direction, and the opening parts of the third member are cutouts (333*h*) that are formed by an edge of the third member encroaching toward the endless belt moving direction.

6. The fusion device according to claim 5, wherein all of the cutouts in the second member are offset with respect to all of the cutouts in the third member in the endless belt moving direction.

7. The fusion device according to claim 1, wherein the opening parts formed in the second member are configured with a combination of through holes, grooves and cutouts, and the opening parts formed in the third member are configured with a combination of through holes, grooves and cutouts.

8. The fusion device according to claim 1, further comprising:

the plurality of opening parts formed in the second member and the plurality of opening parts formed in the third member are arranged in a checked pattern in the rotational axis direction of the endless belt.

9. The fusion device according to claim 8, wherein the opening parts formed in the second member are configured with a combination of through holes, grooves and cutouts, and the opening parts formed in the third member are a combination of through holes, grooves and cutouts.

10. The fusion device according to claim 1, further comprising:

a first roller that is arranged on an inner circumference side of the endless belt;

a pressure application member that is arranged on the inner circumference side of the endless belt and that is arranged on an upstream side of the first roller in the endless belt moving direction; and a second roller that is arranged to face the first roller and the pressure application member over the endless belt.

11. The fusion device according to claim 1, wherein the second member has a second member width ($L_F$2) in the endless belt moving direction, a shape of the opening parts of the second member is substantially circular, and a diameter of the opening parts falls within a range from 20% to 70% with respect to the second member width ($L_F$2).

12. The fusion device according to claim 1, wherein the third member has a third member width ($L_F$3) in the endless belt moving direction, a shape of the opening parts of the third member is substantially circular, and a diameter of the opening parts falls within a range from 20% to 70% with respect to the third member width ($L_F$3).

13. The fusion device according to claim 1, wherein the first, second and third members are made of the same material, and an average thickness of the first member is thinner than those of the second and third members.

14. An image forming apparatus, comprising:

an image forming part that is configured to form a developer image on a print medium; and the fusion device according to claim 1, wherein the fusion device is configured to fuse the developer image formed on the print medium by heat from the heating member.

* * * * *